US010582794B1

(12) United States Patent
Ekkert

(10) Patent No.: US 10,582,794 B1
(45) Date of Patent: Mar. 10, 2020

(54) EYEWEAR HOLDER

(71) Applicant: Len Ekkert, Lemont, IL (US)

(72) Inventor: Len Ekkert, Lemont, IL (US)

( * ) Notice: Subject to any disclaimer, the term of this patent is extended or adjusted under 35 U.S.C. 154(b) by 0 days.

(21) Appl. No.: 16/163,042

(22) Filed: Oct. 17, 2018

(51) Int. Cl.
*A47G 29/00* (2006.01)

(52) U.S. Cl.
CPC ..... *A47G 29/00* (2013.01)

(58) Field of Classification Search
CPC ..... A47G 29/00; A47G 29/08; A47F 7/02; B60R 7/02; Y10S 248/902
See application file for complete search history.

(56) References Cited

U.S. PATENT DOCUMENTS

D161,850 S * 2/1951 Maier ..... A47F 7/021 D3/266
D185,746 S * 7/1959 Glover ..... D3/266
3,259,348 A * 7/1966 Dann ..... A47G 29/08 248/205.3
3,291,429 A * 12/1966 Neanhouse ..... B60R 7/082 248/206.5
D251,596 S * 4/1979 Priestley, Jr. ..... D3/266
D298,436 S * 11/1988 Pralutsky ..... A47F 7/021 D3/266
4,867,402 A 9/1989 Benson et al.
5,056,668 A * 10/1991 Berger ..... A47F 7/021 211/85.1
5,100,006 A * 3/1992 Forrester ..... A47F 7/021 211/85.1
5,137,242 A 8/1992 Reath
5,316,252 A 5/1994 Charnow et al.
5,372,345 A 12/1994 Schmidt
5,507,461 A 4/1996 Ackeret
D374,786 S * 10/1996 Liebers ..... A47F 7/021 D20/42
5,592,244 A * 1/1997 Vyhmeister ..... A47F 7/021 248/309.1
D381,806 S * 8/1997 Land ..... D3/263
D391,759 S * 3/1998 Zudall ..... D3/266
D393,557 S * 4/1998 Guccione ..... D3/266
6,135,407 A 10/2000 Havis et al.
6,302,369 B1 * 10/2001 Liebers ..... A47F 7/021 248/205.3
D466,292 S * 12/2002 Hulback ..... D3/265
(Continued)

*Primary Examiner* — Anita M King
(74) *Attorney, Agent, or Firm* — Husch Blackwell LLP

(57) ABSTRACT

A device is adapted for positioning or mounting onto a surface, for holding eyewear or eyewear lenses in a substantially upright or nearly vertical position. The eyewear holder has a base member beneath an elongated bridge supporting member. The bridge supporting member can have a top surface configured for balancing the eyewear in the upright position and for restricting backward and downward movements of the eyewear. The base member can support a front retaining wall for restricting forward movement of the balanced eyewear; it can support a back retaining wall for restricting backward movement of the balanced eyewear. The retaining walls can have lateral walls that restrict sideward movement of the eyewear. In embodiments having both front and back retaining walls, they can define a slot transverse to the bridge supporting member, the slot for holding the eyewear and for minimizing forward, backward, and rotational movement of the eyewear.

17 Claims, 17 Drawing Sheets

(56) References Cited

U.S. PATENT DOCUMENTS

| | | | |
|---|---|---|---|
| 7,607,627 | B1 | 10/2009 | McHatet |
| 8,177,079 | B2 | 5/2012 | Pezzati et al. |
| 8,328,028 | B1 | 12/2012 | Freilich |

* cited by examiner

EYEWEAR HOLDER

BACKGROUND

Eyeglasses and sunglasses typically are comprised of a frame supported on the bridge of the nose to which right and left temple pieces are attached to extend along the side of the wearer's head to a point past the ears so that the cooperation between the supports of the bridge of the nose and ears maintains the eyeglass or sunglass frame in place with the lenses positioned directly in front of the eyes.

Eyeglasses are often lost or damaged after being left on surfaces or in places inappropriate for these delicate optical devices. For example, eyeglass lenses can be scratched when the eyeglass is deposited lens-side-down onto another surface having hard protrusions or sharp edges. Even where such surface is smooth and flat, it can harbor particles of dust or dirt that can scratch the lenses. Even a perfectly clean surface can nonetheless scratch eyeglass lenses that come into contact with it.

Further, eyewear can be casually misplaced, costing time and effort to find and retrieve it. Eyewear left on a car seat, or other surface, can be warped or crushed when a person sits on them or deposits other items on top of them. Eyewear left on lying on a counter can be overlooked or obscured by other items placed atop or in front of them.

While driving or operating a vehicle, loose eyewear can create a safety hazard when a driver visually looks or manually gropes for loose or misplaced eyewear. A similar hazard can be posed when a driver fumbles with an eyewear case while trying to open or close it.

There is a need for devices that hold eyewear in an upright or near vertical position to prevent damage to the eyewear, yet have the glasses maintained in an orientation that is readily accessible to the user when desired. There is also a need for an eyewear holder that can rest atop a surface, or be mounted to another surface or device, which can orient and secure the eyewear in an upright, substantially vertical position, to hold the eyewear in a readily accessible location and position for retrieval.

SUMMARY OF THE INVENTION

A main aspect of the invention particularly relates to a device for holding an eyeglass, the eyeglass holder comprising: i) a base member; ii) a bridge supporting member atop the base member, the bridge supporting member including: a) a front end proximate to a front side of the base member; b) a back end proximate to a back side of the base member; c) first and second lateral walls, each lateral wall joining a central portion of the base member, and each lateral wall facing a lateral side of the base member; and d) a top surface comprising first, second, and third segments, respectively, the first segment joining the second segment at a first transverse angle, and the second segment joining the third segment at a second transverse angle; and iii) a front retaining wall atop the base member, the front retaining wall between the bridge supporting member and the front side of the base member; such that when the eyeglass is seated in the eyeglass holder, each of the base member, front retaining wall, the second segment, third segment, the first lateral wall, and the second lateral wall for communicating with a different location of the eyeglass; and such that when the eyeglass straddles the bridge supporting member, the front retaining wall for restricting a forward movement of the eyeglass, the second segment for restricting a backward movement of the eyeglass, and the bridge supporting member for restricting a sideward movement of the eyeglass, and the eyeglass is maintained in a substantially (or near upright) upright position.

Another aspect of the eyeglass holder includes a central portion of the front retaining wall is located proximate to the front end of the bridge supporting member.

An additional aspect of the eyeglass holder includes a plurality of front retaining walls, each front retaining wall proximate to the front side of the base member, and each front retaining wall for restricting the forward movement of the eyeglass when the eyeglass straddles the bridge supporting member. A further aspect of the eyeglass holder includes the front retaining walls defining a common plane.

Other aspects of the eyeglass holder include a back retaining wall proximate to the back side of the base member, the back retaining wall for communicating with a folded temple of the eyeglass; such that when the eyeglass straddles the eyeglass holder, the back retaining wall for restricting the backward movement of the eyeglass when the eyeglass straddles the eyeglass holder.

Additional aspects of the eyeglass holder include the back retaining wall having i) a central portion proximate to the back end of the bridge supporting member; and ii) an end portion flanking each side of the central portion, each end portion proximate to a lateral side of the base member.

An additional aspect of the eyeglass holder includes the front retaining wall and the back retaining wall defining a slot, the slot transverse to the bridge supporting member, and the slot for engaging the eyeglass.

Another aspect of the eyeglass holder includes the eyeglass holder such that a height of the front retaining wall is less than a height of the back retaining wall, (but can be the same or higher) and the height of the back retaining wall is less than a height of the bridge supporting member.

Yet another aspect of the eyeglass holder includes each lateral wall joining the bridge supporting at a transverse angle, and each lateral wall extending toward each other.

Other aspects of the eyeglass holder include the bridge supporting member comprising a fourth segment, the fourth segment extending between the third segment and the back end of the bridge supporting member at a third transverse angle.

Another main aspect of the invention particularly relates to a device for holding an eyeglass, the eyeglass in a folded or unfolded configuration, comprising: i) a base member; ii) first and second retaining walls extending upward from the base member; and iii) an elongated bridge supporting member between the retaining walls, the elongated bridge supporting member having first and second ends joining the first and second retaining walls, respectively; and an upper surface, the elongated bridge supporting member adapted for receiving a bridge of the eyeglass; such that when the eyeglass is held in the device, a first portion of the eyeglass is positioned between the retaining walls, the elongated bridge supporting member for communicating with a second portion of the eyeglass, and the eyeglass adopts a substantially upright position.

Another aspect relates to the device such that when the eyeglass is held in the device, the retaining walls are spaced close enough to prevent the eyeglass from adopting a horizontal position.

An additional aspect of the device relates to the device such that when the eyeglass is held in the device, the base member is for communicating with a third portion of the eyeglass.

Other aspects of the device include the elongated bridge supporting member comprising first and second lateral walls, each lateral wall extending between the base member and the upper surface of the elongated bridge supporting member; such that when the eyeglass is held in the device, each lateral wall for communicating with a fourth portion of the eyeglass.

Additional aspects of the device include the elongated bridge supporting member having a width greater than or equal to 0.050 inches and less than or equal to 1.25 inches.

Yet additional aspects of the device include the device having a height of greater than or equal to 0.250 inches and less than or equal to 3.000 inches.

Another aspect of the device includes at least one supplemental wall, the at least one supplemental wall connecting to a lateral side of one retaining wall, and the at least one supplemental wall extending toward another retaining wall; such that when the eyeglass is held in the device, the at least one supplemental wall for communicating with the first portion of the eyeglass.

Yet another aspect of the device includes the bridge supporting member having a top surface, the top surface comprising: i) a first segment having a first height, the first segment joining the first retaining wall; ii) a second segment joining the first segment to a third segment, the second segment positioned at a transverse angle between the first and second segments; iii) the third segment having a second height, the third segment joining the second retaining wall; and iv) first and second lateral walls opposite each other, each lateral wall extending between the top surface and the base member; such that when the eyeglass is held in the device, the second segment for communicating with the second portion of the eyeglass.

Another main aspect of the invention particularly relates to a device for holding an eyeglass, the eyeglass including i) a frame with ii) lenses connected by iii) a bridge, and iv) temples attached to the frame which can be folded inwardly toward the frame, the eyeglass holder comprising: a) a base member; b) first and second retaining walls extending upward from the base member; and c) an elongated bridge supporting member spanning between the retaining walls, the elongated bridge supporting member having an upper surface, the upper surface including a segment defining a depressed groove, and the elongated bridge supporting member adapted for communicating with the bridge of the eyeglass; such that when the eyeglass is held in the device, the lenses are positioned between the retaining walls, the elongated bridge supporting member for communicating with the bridge of the eyeglass, and the eyeglass adopts a substantially upright position.

Another aspect of the device includes the depressed groove of the elongated bridge supporting member defining a U-shaped profile, the U-shaped profile for communicating with the eyeglass.

BRIEF DESCRIPTION OF THE DRAWINGS

FIG. 2A shows top views of numerous embodiments, FIG. 2B show side perspective views of numerous embodiments, and FIG. 2C shows top perspective views of numerous embodiments;

FIGS. 9A and 9D shows perspective views, FIG. 9B shows a side view, FIG. 9C shows a top view, and FIGS. 9E-9G show perspective views of an eyewear holder holding an eyeglass;

FIG. 10A shows a perspective view, FIG. 10B shows a side view, FIG. 10C shows a front view, and FIG. 10D shows a top view;

FIG. 11A shows a perspective view, FIG. 11B shows a side view, and FIG. 11C shows a top view; FIG. 12A shows a perspective view, FIG. 12B shows a top view, FIG. 12C shows a perspective view of the holder holding eyewear, FIGS. 12D-E shows top perspective views of the holder holding eyewear, and FIG. 12F shows a side view of the holder holding eyewear.

DETAILED DESCRIPTION OF THE INVENTION

Figure 1:
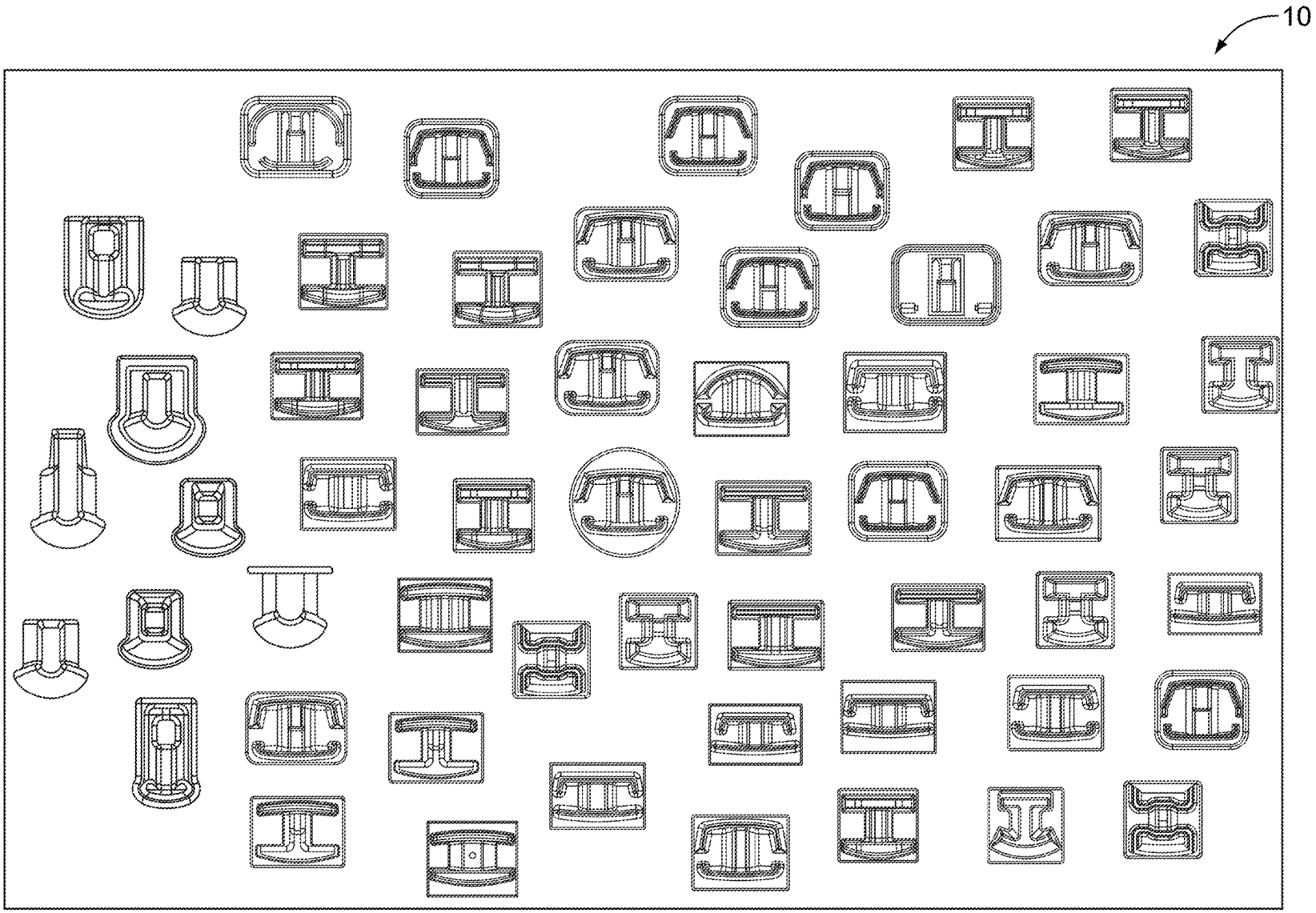
FIG. 1 shows a front perspective view of numerous embodiments of the eyewear holders of the present invention.

The terms "eyewear" and "eyeglasses," as used throughout the specification and claims are intended to include, but is not limited to, any glasses, eyeglasses, sunglasses, eyewear, or spectacles with frames bearing lenses, worn in front of the eyes normally for vision correction, eye protection, or for protection from various wavelengths of light.

Embodiments of the present invention can be used for any type of eyewear including but not limited to eyeglass frames commonly made from metal, horn or plastic. Any lenses in the frames are also accommodated by the present invention including but not limited to those made from glass, or plastic, or polycarbonate.

A pair of eyeglasses 301, indicated generally at FIGS. 2-9, is disposed on the eyewear holder 10. The eyeglass 301 can include a frame 303 holding a pair of lenses 305. The frame 303 can include a bridge 307 extending between and connecting the lenses 305. The frame 303 can include a border 309 surrounding all or part of each lens 305, and temples or ear pieces 311 extending rearwardly from lenses 305, as is well known in the art.

FIGS. 1-12 illustrate a device 10 for holding a pair of eyeglasses. The eyewear holder 10 can be light weight, aesthetically pleasing, and can be easily and conveniently oriented to secure the pair of eyeglasses 301, for easy retrieval as required or desired by the user of the product. The eyeglass holder 10 can include a base member 20, a pair of spaced-apart retaining walls 56 and 58 extending from base member 20, and a supporting member 80 that connects the spaced-apart retaining walls 56 and 58. The base member 20, retaining walls 56 and 58, and bridge supporting member 80 can share a common central longitudinal axis, so that the device 10 exhibits mirror symmetry around a plane formed along the common central longitudinal axis.

When an eyeglass 301 is placed onto an embodiment of the eyewear holder 10, portions of the eyewear can be secured by the device 10 so as to maintain the eyeglass 301 in a substantially (or near upright position) upright position. This is accomplished by providing multiple secure contact points between the eyeglass 301 and the device 10. Different portions of the eyeglass 301 can contact different sites on the base member 20, bridge supporting member 80, front retaining wall 56, back retaining wall 58, supplemental wall 70, tabs 161, and other structures of the device 10. It is preferred that the eyeglass 301 contact the device 10 in at least two, three, four, or more locations on the device.

As shown in FIG. 10, the device 10 can define a slot 116 into which the eyewear 301 can be inserted, the front and back sides 118, 120 of the slot 116 communicating with front and back portions of the eyewear 301. The bottom side 124 of the slot 116 and/or the lateral sides 92 of the bridge supporting member 80 can communicate with bottom portions of the eyewear 301.

The Base Member

The base member 20 can define a generally planar or wall-like structure, having an upper surface 24 and a lower surface 26. The lower surface 26 of the base member 20 is meant to communicate with another surface, such as a tabletop, counter, or automobile dashboard, and can facilitate the placement of the device on a generally flat surface or to mate with the topography of another surface. The opposite, upper surface 24 of the base member 20 can support a bridge supporting member 80 or a pair of retaining walls 56 and 58, structures that can extend in a substantially perpendicular direction upward and away from the upper surface 24 of the base member 20. When the device 10 is positioned on the generally flat surface, a bridge supporting member 80 or retaining walls 56 and 58 can extend in an upward direction.

The base member 20 can have a front side or end 23 and, on the opposite side or end, a back side or end 25. A lateral or side or end 27 can extend and connect one edge of the front side 23 to one edge of the back side 25, with another lateral or side end 27 connecting the other edge of the front side 23 to the other edge of the back side 25.

When viewed from a bottom perspective, the lower surface 26 of the base member 20 can define a solid, continuous or contiguous surface. In some embodiments, a central portion 28 of the base member 20 can include an orifice or perforation, providing an opening that extends into a hollow interior portion of the device 10.

When viewed from above, the outer edges of the base member 20 can include a peripheral border 21 supporting a flange or projection 22 that extends the footprint of the device 10 past the outer edges of the retaining walls 56 and 58 and/or bridge supporting member 80; preferably, such peripheral border 21 extends a uniform distance outward from the edges of the retaining walls 56 and 58 and/or bridge supporting member 80. However, the peripheral border 21 need not follow the shape or contour of the base member 20; that is, an outer periphery of the peripheral border 21 can have a different shape than the base member 20. Thus the peripheral border 21 or flange 22 can increase the surface area of the base of the device 10 and enhance the stability of the device 10 as it sits or rests on the surface upon which it rests or is mounted. When viewed from above or below, the base member 20 can define a shape that can accommodate various mounting positions and surfaces. As shown in FIGS. 1-2, a base member 20 can be round or oval, square or rectangular, a regular polygon, an irregular polygon, or other shape. The base member 20 can be made in a variety of shapes and sizes, to accommodate a variety of surfaces upon which the device 10 can be mounted.

It is preferred that the base member 20 have flat or planar upper and lower surfaces 24, 26, but they can possess any shape suitable for the device 10 to hold an eyeglass 301 in a substantially upright (or near vertical) position. For example, the lower surface 26 of the base member 20 can define a curve to enable the device 10 to be placed on a curved surface, such as a railing.

The base member 20 can include a flange 22 extending downward from the peripheral border 21 or the base member 20. The flange 22 can add to the overall height of the device 10. The flange 22 can be arranged to block the visual detection of the mounting members placed on the bottom surface 26 of the base member 20. Such flange 22 can define a continuous surface of uniform height, but can include cutouts or interruptions.

While the base member 20 provides support for the retaining walls 56 and 58 and bridge supporting member 80, it can adopt a shape that extends past these structures. In some embodiments, the base member 20 can define an extended surface that can act as a platform for stabilizing the device 10. In other embodiments, the base member 20 can adopt a shape that surrounds the retaining walls 56 and 58 and bridge supporting member 80, and provides a smaller, non-extended platform structure, or no platform structure at all.

When an eyeglass 301 is held in the device 10, the base member 20 can support the bottom surfaces of the eyeglass 301, and can particularly communicate with a bottom portion of the periphery 313 of a lens 305 (or a bottom portion of the periphery 315 of a frame 303 surrounding a lens 305) and/or a bottom portion of an eyeglass temple 311.

The Retaining Walls

The base member 20 can support one or more retaining walls 56 and 58 atop it. Each retaining wall 56 and 58 can be joined to the base member 20, and extend upwardly or outwardly from the base member 20. Each retaining wall 56 and 58 can include a generally planar or wall-like structure having a first, inner surface or wall 52 and a second, outer surface or wall 54 opposite the inner surface 52. Each retaining wall 56 and 58 can include lateral walls 68 extending between and joining the inner and outer walls 52, 54 of the retaining wall, and an upper or top side 62 facing away from the base member 20. It is preferred that each retaining wall 56 and 58 join or be proximate to either the front or back sides 23, 25 of the base member 20.

Figure 9A:
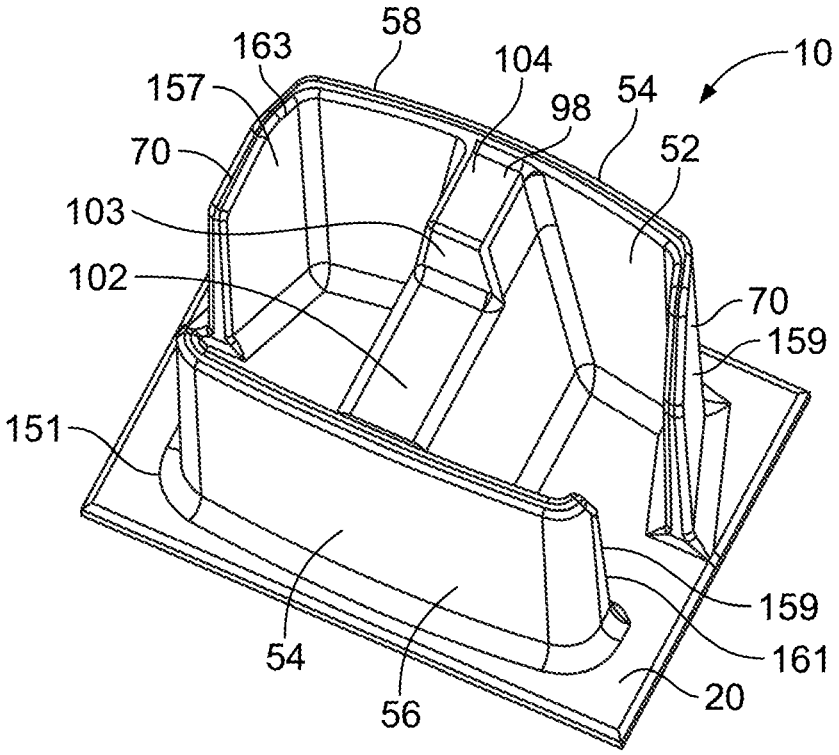
FIGS. 9A-9G show views of an embodiment of an eyewear holder.
Figure 9B:
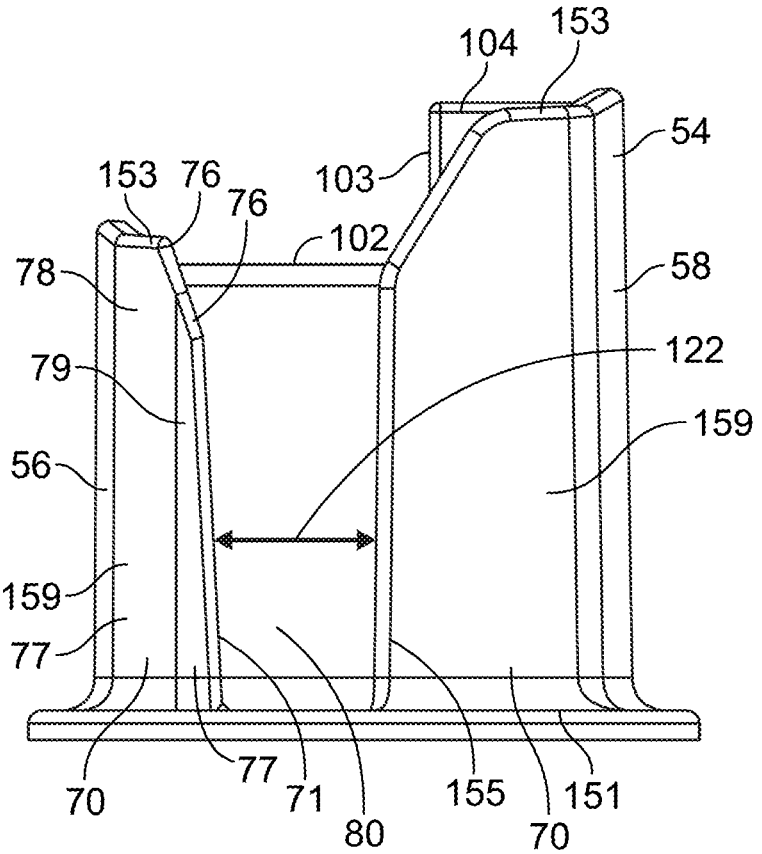
Figure 9C:
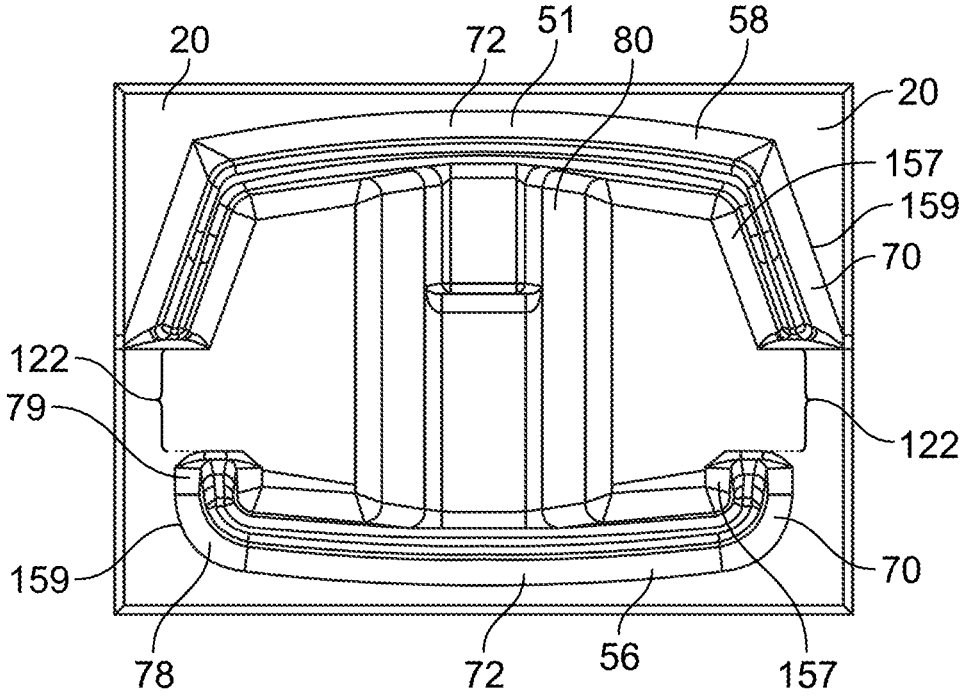
Figure 9D:
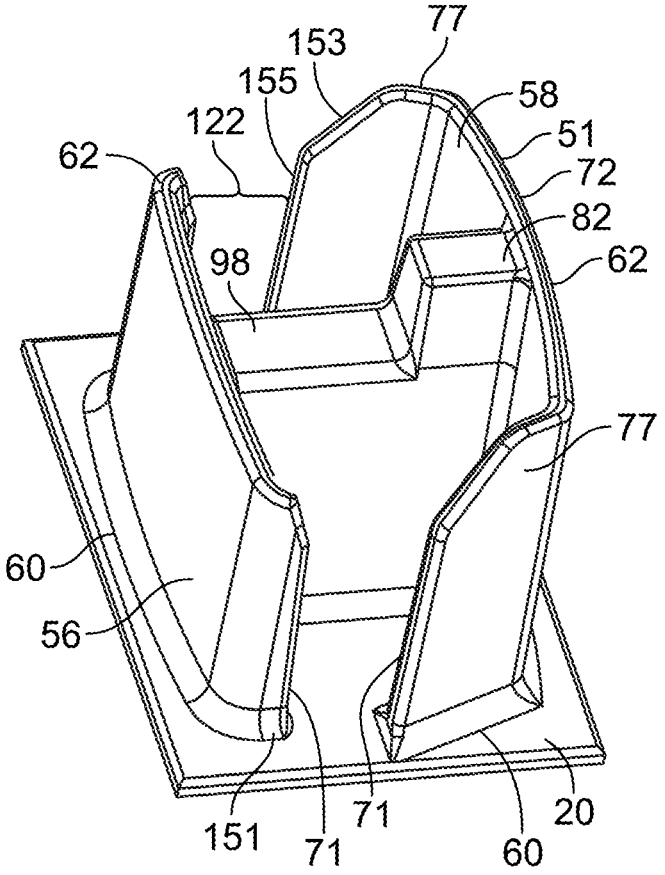
Figure 9E:
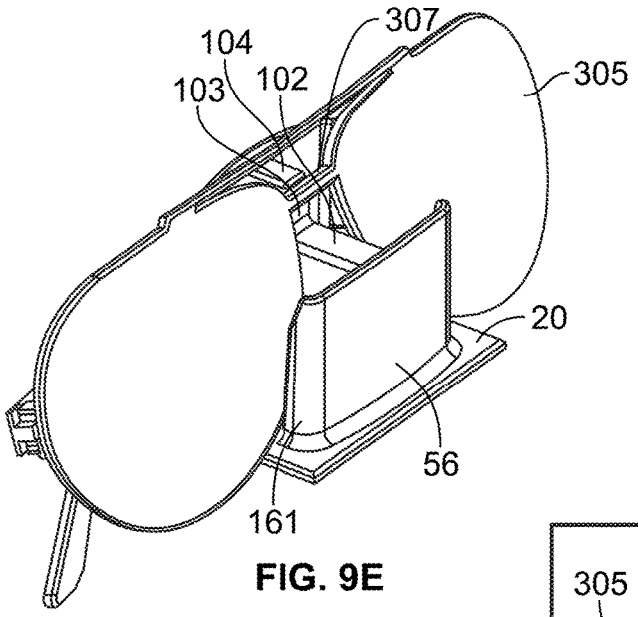
Figure 9F:
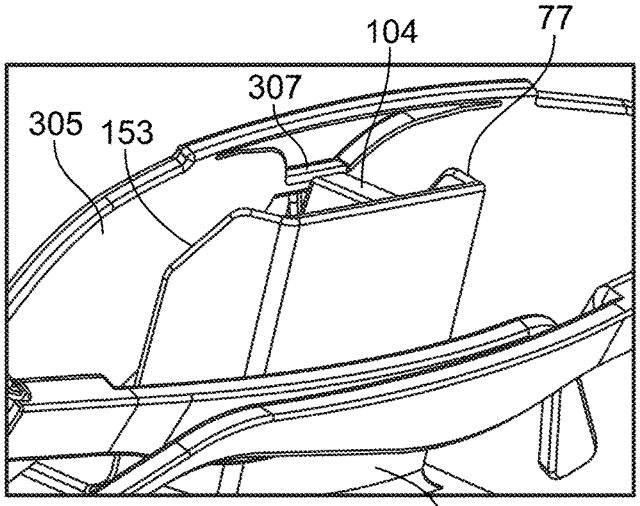
Figure 9G:
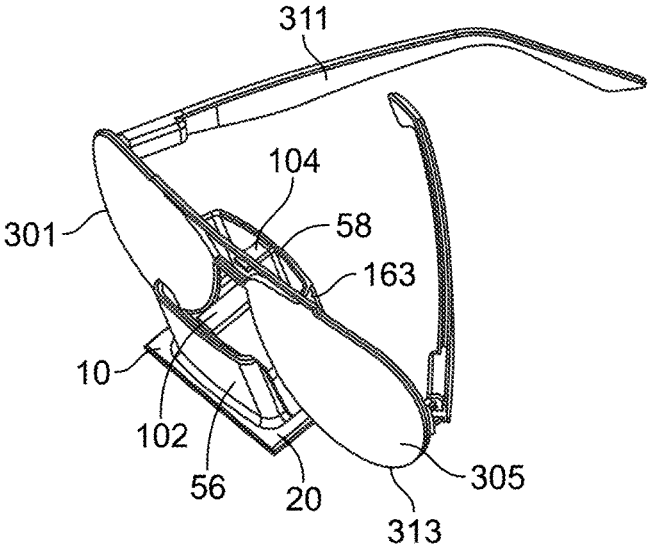

As shown in FIGS. 1-2, the retaining walls 56 and 58 can form a variety of shapes. A retaining wall 56 and 58 can define planar surfaces (as shown in FIG. 9E). A retaining wall 56 and 58 can have a curving surface (as shown in FIG. 10D). A retaining wall 56 and 58 can join or connect a supplemental wall 70 (as shown in FIG. 9C). A retaining wall 56 and 58 can have a portion that is proximate to a lateral wall 27 of the base member 20, or connect to a supplemental wall 70 having a portion proximate to a lateral wall 27 of the base member 20.

These different embodiments can facilitate the positioning of an eyeglass 301 in an upright orientation.

Where there is both a front retaining wall 56 and a back retaining wall 58, the retaining walls 56 and 58 can be arranged substantially parallel to each other, so that the inner surface 52 of one of the retaining walls 56 faces the inner surface 52 of the other of the retaining walls 58. A pair of retaining walls 56, 58 can be positioned to define a slot 116 between them. In some embodiments, the retaining walls 56, 58 differ from each other in size, length, shape, height, width, thickness, or curvature (as shown in FIGS. 3, 9, 10).

Each retaining wall 56 and 58 can attach to an end of the elongated bridge supporting member 80, front retaining walls 56 attaching to the front end 86 of the bridge supporting member 80, and back retaining walls 58 attaching to the back end 88 of the bridge supporting member 80. In some embodiments, the retaining walls are proximate to the bridge supporting member 80, rather than attached to it. In some embodiments, front and back retaining walls 56, 58 attach to opposite ends 86, 88 of an elongated bridge supporting member 80.

Where there are front and back retaining walls 56, 58, when viewed from above, they can be oriented to be generally parallel to each other. Where a pair of retaining walls 56, 58 are curved, it is preferred that the arcs defines by each retaining wall 56, 58 be arranged so that the arcs mirror each other (or face each other), rather than parallel each other. Viewed together, from a top or bottom view, pairs of retaining walls 56, 58 can define a generally oval or rectangular shape that approximates the size and shape of a folded eyeglass 301 when viewed from a top or bottom perspective.

Together, front and back retaining walls 56, 58 can define a slot 116 for receiving the folded eyeglass, to enable the eyeglass to contact (e.g., straddle) the bridge supporting member 80. The slot 116 can be oriented perpendicular or transverse to the bridge supporting member 80.

The retaining walls 56 and 58 can extend upward from the upper surface 24 of the base member 20, defining planes that are perpendicular to the base member 20, and parallel to each other. In other embodiments, the retaining walls 56 and 58 can extend upward from the base member 20 and away from each other, to accommodate the eyewear 301 being positioned into the eyewear holder 10, or to accommodate different mounting systems. A retaining wall 56 and 58 can have a range of thicknesses.

A bottom side 60 of each retaining wall 56 and 58 can join or connect to the upper surface 24 of the base member 20, with the retaining wall 56 and 58 extending away from the base member 20 to define a top side or upper surface 24, the top side 24 opposite the bottom side or lower surface 26.

When an eyeglass 301 is held in the device 10, a retaining wall 56 and 58 can limit the forward or backward movement of the eyeglass 301. Together, the front and back retaining walls 56, 58 can prevent the eyeglass 301 from sliding forward and backward at all, or allow the eyeglass 301 some space to move forward or backward and to tilt at an angle, but not enough space for the eyeglass 301 to move from a substantially vertical position to a horizontal position.

A front retaining wall 56 can provide support to a first side of the eyeglass 301. The front retaining wall 56 can be for communicating with the front surfaces of the eyeglass 301, particularly with an outer or upper surface 317 of a lens 305, that is, the surface facing away from the wearer when the eyewear 301 is worn. A back retaining wall 58 can provide support to a second, opposite side of the eyeglass 301; the back retaining wall 58 can provide support to and be for communicating with the folded temples 311 or arms of the eyeglass frame 303.

The retaining walls 56 and 58 can be mirror images of each other, but in some embodiments, a first retaining wall 56 positioned at a front portion 14 of the device 10 can have a different size, shape, height, width, or thickness than a second retaining wall 58 positioned at the back portion 16 of the device 10. It is preferred that each retaining wall 56 and 58 be of sufficient height to allow the eyewear lenses 305 to straddle the bridge supporting member 80 while maintaining the eyeglass 301 in a generally vertical orientation, when the eyeglass 307 is placed into or onto the device 10. This height can be as short as 0.250 inches or as tall as 3.0 inches.

In some embodiments, the retaining walls 56 and 58 include inner or outer surfaces 52, 54 that have flat and planar surfaces; in some embodiments, those surface 52, 54 of the retaining wall 56 and 58 can define a curved inner or outer surface. The retaining walls 56 and 58 can include straight, planar walls or curving partitions or barriers that communicate with the inserted eyewear 301 and hold it upright. These partitions or barriers provide physical limitations on the distance that the eyewear can move between the retaining walls 56 and 58, either backward-and-forward movement or rotational movement, and maintain a distance for holding the front and back surfaces of the eyeglass lenses 305 in a substantially upright (or near vertical) position relative to the retaining walls 56 and 58.

The top walls or sides 62 of the retaining walls 56 and 58 can define planar, flat surfaces or irregular, convex, or concave surfaces. The top walls 62 can have straight or flat top edges, or edges that taper downward or upward. The retaining wall 56 and 58 can have a profile that is rectangular, square, triangular, trapezoidal, or other regular or irregular polygonal shapes. The retaining wall 56 and 58 can possess a uniform thickness, or have thinner or thicker sections. It is preferred that the top surface 62 of each retaining wall 56 and 58 be smaller than or equal to in width to the base side 60 of that retaining wall 56 and 58.

The top walls 62 can have a U-shaped profile or cross-section, when viewed from the front or rear views, where the lower portion of the U-shape meets the upper surface 82 of the bridge supporting member 80. The top walls 62 can define a profile having a sinusoidal or wave shape, where the lower portion of the U-shape meets the upper surface 82 of the bridge supporting member 80.

One or both retaining walls 56 and 58 can include a depression or recessed portion 66 positioned in the center or central portion 63 of its top side 62, the depression 66 for guiding a thumb and opposing digit to grasp an eyeglass held within the eyewear holder 10.

Figure 8A:
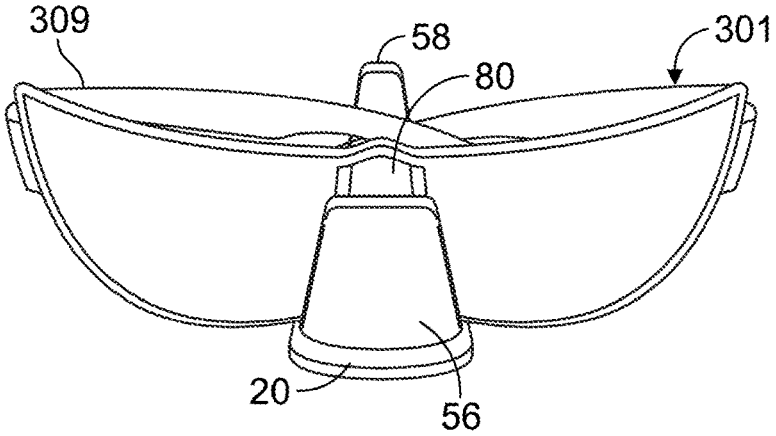
FIGS. 8A-8C show perspective views of an embodiment of an eyewear holder holding a pair of eyeglasses.
Figure 8B:
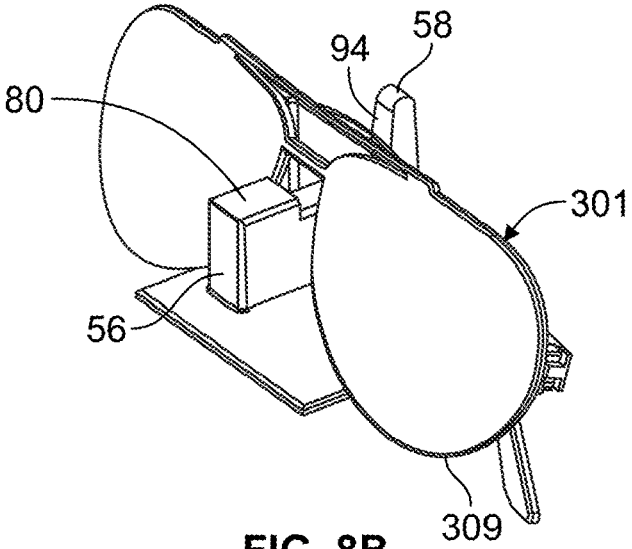

Such depression 66 can define structure for supporting or communicating with a portion of the eyewear 301, such as the bridge 307 while the folded temples 311 communicate with the inner or outer surfaces 52, 54 of one or more retaining walls 56 and 58, or while the lenses 305 communicate with the lateral surfaces 92 of the bridge supporting member 80. As another example, such depression 66 can support or communicate with the folded temples 311 of an eyeglass 301, as shown in FIGS. 8A-8B.

Each retaining wall 56 and 58 can include supplemental walls 70 attached to and communicating with its lateral walls 68. Each supplemental wall 70 can form a straight path positioned at a substantially right angle where it joins the side wall or lateral surface 68 of the retaining wall 56 and 58. Each supplemental wall 70 can curve or angle inward toward the bridge supporting member 80. Each supplemental wall 70 can extend from the base member 20 along an entire length or along a portion of the length of the lateral side 68 of the retaining wall 56 and 58.

When an eyeglass 301 is held in the device 10, the supplemental walls 70 can create lateral barriers that limit the lateral or sideways movement of the eyeglass 301, helping to keep the eyeglass 301 in a substantially (near upright) upright position. If the retaining walls (e.g., 56, 58) are placed too far apart from each other, the eyeglass 301 held between them can move within the device 10 and lose their upright orientation. The addition of the supplemental walls 70 provide one or more points where the eyeglass 301 is limited to a space that is smaller or narrower than the space between the retaining walls 56 and 58; this feature allows the eyewear holder 10 to be made with retaining walls 56 and 58 set apart at distances that would otherwise allow the held eyeglass 301 to move out of the device 10 or rotate enough to lose its upright orientation.

Each retaining wall 56 and 58 can include outward-curving outer surfaces 54 attached to and communicating with their lateral walls 68.

Each retaining wall 56 and 58 can include one or more internal projections that can come into contact with the lenses of the eyewear 301 when the eyewear 301 is inserted into the device 10. The internal projections can include a protrusion or protuberance extending from the inner surface 52 of one retaining wall (e.g., 56) toward the inner surface 52 other retaining wall (e.g., 58). Ideally, an internal projection can project to touch an eyeglass lens 305, or extend to a distance that falls short of touching the eyeglass lens 305. However, the internal projections can be oriented to contact other portions of the eyeglass 301. This feature allows the eyewear holder 10 to be made with retaining walls 56 and 58 set apart at distances that would otherwise allow the held eyeglass 301 to move or rotate enough to lose its upright orientation. Similar projections can extend outward from the outer surface 54 of a retaining wall 56 and 58.

Like the supplemental walls 70, these projections can provide a structure that can help to guide or maintain the eyewear 301 in a near vertical position, but where the supplemental walls 70 can restrict lateral movement within the device 10, the internal projections can limit the amount of room in which the eyewear 301 can move forward or backward within the device 10 or rotate within the device 10. Both supplemental walls 70 and internal projections can act to support the eyewear 301 in a near vertical position.

The retaining walls 56 and 58 can be spaced apart from each other, with a bridge supporting member 80 extending between the inner surfaces 52 of the front and back retaining walls 56, 58. The bridge supporting member 80 can join the first retaining wall 56 to the second retaining wall 58. The bridge supporting member 80 is meant to provide a structure that can support the bridge 307 and/or folded temples 311 of an eyeglass 301 that is being held in the eyewear holder 10.

The Bridge Supporting Member

The eyewear holder 10 is designed to hold an eyeglass 301 in in upright position; the bridge supporting member 80 provides the structure upon which the bridge 307 of the eyewear 301 is balanced. The bridge supporting member 80 also provides several points of communication between the device 10 and the seated eyeglass 301.

The bridge supporting member 80 can be provided as an elongated wall, having a length greater than its width. Viewed from above, it can have a rectangular shape. The bottom surface 84 can be arranged atop the base member 20. Its top surface 82 can be flat or planar, or can have multiple segments 98 having different elevations or heights, or joining each other at the same or different angles A bridge supporting member 80 can be oriented along a longitudinal axis of the base member 20; the front end 86 can be located proximate to the front side 23 of the base member 20, the back end 88 can be located proximate to the back side 25 of the base member 20. It is preferred that the bridge supporting member 80 be located in a central portion 28 of the base member 20, or define a midline of the base member 20.

A bottom surface 84 of the bridge supporting member 80 can be joined or connected to the upper surface 24 of the base member 20, and opposite ends 86, 88 of the bridge supporting member 80 can be joined or connected or located proximate to the inner surfaces 52 of each of the retaining walls 56 and 58 (in embodiments having front or back retaining walls 56, 58). The bridge supporting member 80 can include an elongated length that spans between the retaining walls 56 and 58, for either the entire length of the retaining walls 56 and 58 or a portion of each retaining wall 56 and 58. This length or distance is preferred to be such so as to accommodate most eyewear 301.

Each bridge supporting member 80 can be specially configured to support a different part of an eyeglass 301. The top surface 82 can be flat and planar, or curved or rounded or convex, or contain a protrusion (e.g., a hump 73) or a depressed segment 94 or groove (e.g., a divot), providing sites for supporting or holding a portion of the eyeglass 301. Some embodiments can include a top surface 82 including neighboring segments (e.g., 102-104), preferably defining planar surfaces, that define an acute or obtuse angle at their junctures. Such junctures can define a structure for supporting the eyewear 301.

Each opposite end 86, 88 of the bridge supporting member 80 can have a width that spans the entire length of one or both retaining walls 56 and 58. In some embodiments, the bridge supporting member 80 can connect a central portion 72 of a first retaining wall 56 to a central portion 72 (of the same or different size) of a second retaining wall 58.

The bridge supporting member 80 can have a height greater than the height of either or both retaining walls 56, 58; the bridge supporting member 80 can have a height less than or the same as the height of either or both retaining walls 56, 58. In some embodiments, one or both of the front or back retaining walls 56, 58 can extend above the bridge supporting member 80 that spans between the retaining walls 56 and 58. In some embodiments, the top surface 82 of the bridge supporting member 80 can share the same plane as the top surface 62 of either or both retaining walls 56, 58.

Like the retaining walls 56 and 58, the height of the bridge supporting member 80 can be as short as 0.250 inches or as tall as 3.0 inches.

The width of the bridge supporting member 80 (a dimension perpendicular to the length of the bridge supporting member 80, along a plane perpendicular to a longitudinal central axis of the bridge supporting member 80) can be between 0.100 inches to 1.25 inches, to accommodate a variety of eyeglasses 301.

The eyewear 301 can be positioned to straddle the bridge supporting member 80, with the bridge 307 or lenses 305 or frame 303 (or nose braces 320 in an eyeglass 301 having a nose brace 320) contacting the bridge supporting member 80. When engaged thus, the bridge supporting member 80 can limit the lateral or side-to-side or right-to-left or left-to-right movement of the eyewear 301 when engaged in the device 10. The retaining walls 56 and 58 can limit the rotational movement of the eyewear 301 around the bridge supporting member 80.

A bridge supporting member 80 can include a portion 90 that spans between the retaining walls 56 and 58 and can be generally triangular or trapezoidal when viewed in cross-section. The bridge supporting member 80 can have a base end or bottom surface 84 that communicates with the base member 20, and a pair of side surfaces 92 joining the base member 20 on one end and joining each other on the opposite end to define an upper surface 82 between them.

The bridge supporting member 80 can include lateral ends or edges 86, 88, between the bottom surface or base end 84 and the upper surface 82, that each join the inner surface 52 of a retaining wall 56 and 58. Such upper surface 82 can extend to a height greater than the height of either or both retaining walls 56, 58; such upper surface 82 can extend to a height shorter than either or both retaining walls 56, 58. A longitudinal central axis of the upper surface 82 can be substantially perpendicular to one or both retaining walls flanking the ridge. Such upper surface 82 can define a flat, curved, or convex upper surface; such upper surface 82 can define a tapering edge, or point or ridge. The top surface 82 can be flat and planar, or curved or rounded or convex, or contains a protrusion (e.g., a hump) or a depression (e.g., a divot); such features can provide a structure for supporting or holding a portion of the eyeglass 301.

Some embodiments can comprise neighboring planar segments (e.g., 102-104) that define an acute, right, or obtuse angle at their junctures. Such junctures can define a bridge supporting member 80 having at least two segments (e.g., 102, 104) having different elevations with respect to each other, and providing a structure for supporting the bridge 307 of an eyeglass 301 engaged within the device 10.

Figure 3A:
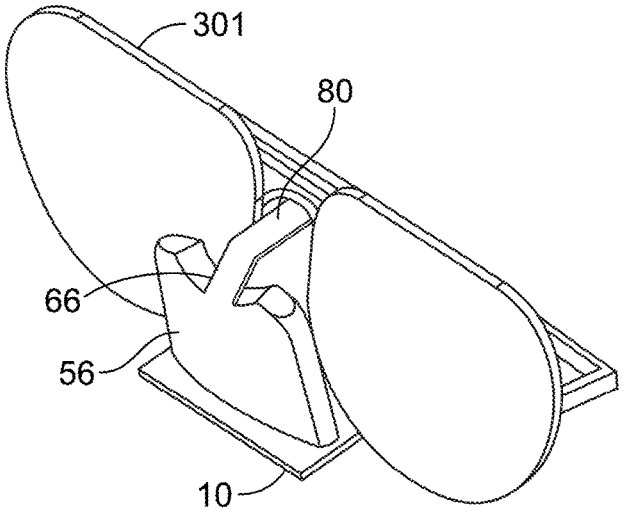
FIGS. 3A-3C show perspective views of eyewear holders holding eyewear.
Figure 3B:
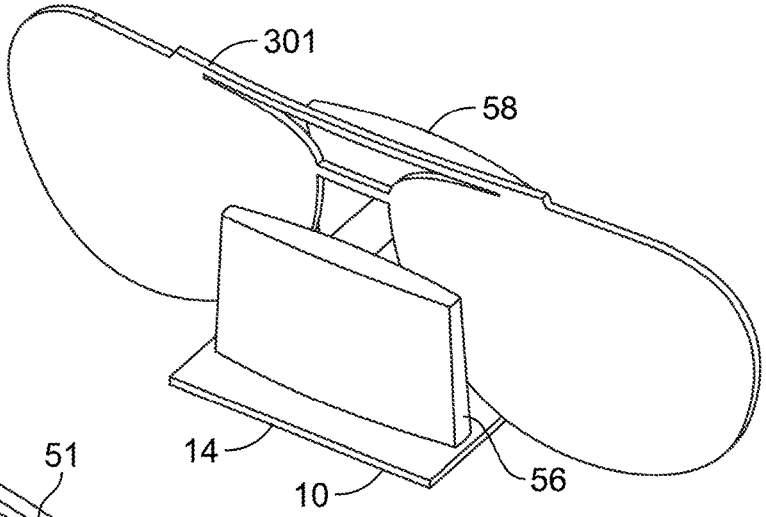
Figure 3C:
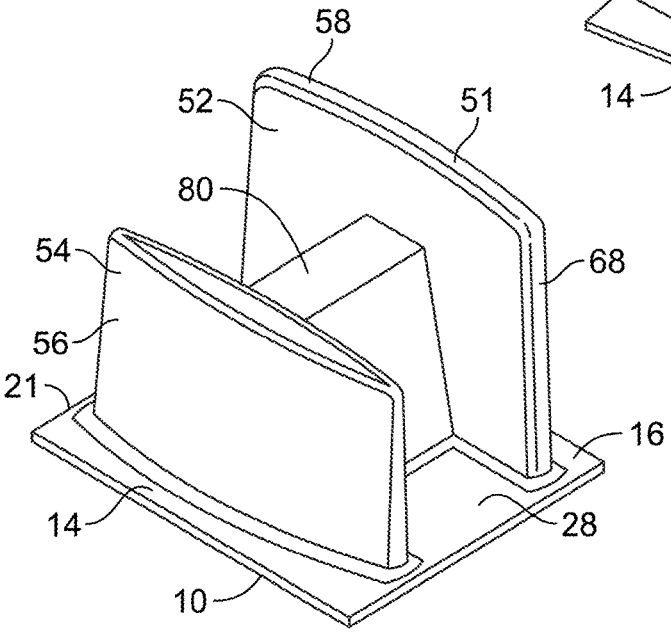

As shown in FIGS. 3A-3C, the bridge supporting member 80 can include an elongated portion 90 extending between and connecting the front and back retaining walls 56, 58. That elongated portion 90 can include a series of segments (e.g., 102-104), each segment (e.g., 103) connected to one or more neighboring segments (e.g., 102, 104). In some embodiments, such segments (e.g., 102) can define a flat, planar surface that connects the front and back retaining walls 56, 58. As shown in FIGS. 3A-3C, neighboring segments can connect so that the segments define an angle (when viewed from a side perspective).

As shown in FIGS. 3A-3C, a first segment 102 can extend from the front retaining wall 56 toward the back retaining wall 58. The first segment 102 can define a flat, planar surface that defines a plane that is located at approximately the same height at the top surface 62 of the front retaining wall 56. A second segment 103 can connect or join the first segment 102 to a third segment 104. The third segment 104 can define a flat, planar surface that defines a plane that is located at approximately the same height at the top surface 62 of the back retaining wall 58. The first and third segments 102, 104 can define planes that are located parallel to each other, but are located at different heights so that the planes do not intersect. The second segment 103 can define a plane that is perpendicular to the planes defined by the first and third segments 102, 104. Together, the three segments 102-104 can define a step-like structure, when viewed from a side perspective. When an eyeglass 301 is placed within the eyewear holder 10, portions of the bridge 307 and/or inner portions of the lenses 305 can communicate with the first segment 102, while the second segment 103 can support the back side of the frame 303, bridge 307, and/or lenses 305. It is envisioned that the third segment 104 does not directly support or communicate with a portion of the eyeglass 301 when the eyeglass 301 is engaged in the device 10.

As shown in FIG. 3A, the elevation or height of the first segment 102 can be the same or similar to that of the top surface 62 of the front retaining wall 56. The top surface 62 of the front retaining wall 56 can extend above the height of the first segment 102, for communicating with a front portion of the eyeglass 301 and helping to keep the eyeglass 301 in a substantially upright position within the device 10.

The elevation of the third segment 104 can be the same or similar to that of the top surface 62 of the back retaining wall 58.

The second segment 103 can define a vertical or downward-sloping or downward-angled surface that can engage a back portion of the eyeglass 301 when engaged within the device 10. The second segment 103 can be positioned on or proximate to a plane defined by the outer edges 71 of supplemental walls 70 joined to the back retaining wall 58. The second segment 103 and the outer edges 71 can provide support for the eyeglass 301 along a back portion of the lenses 305 and/or bridge 307.

As shown in FIGS. 7A-7D, the segments 102-104 can have lengths that are different from each other. For example, the first segment 102 can have a length greater than the second segment 103, which in turn can have a greater length than the third segment 104.

Figure 2A:
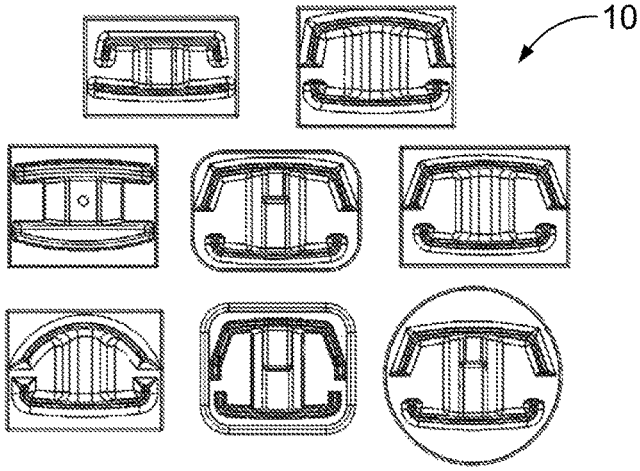
FIGS. 2A-2C show perspective views of embodiments of the eyewear holders, either alone or holding eyewear.
Figure 2B:
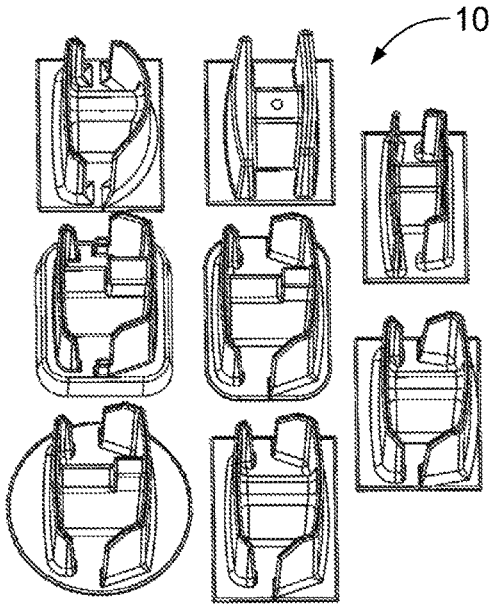
Figure 2C:
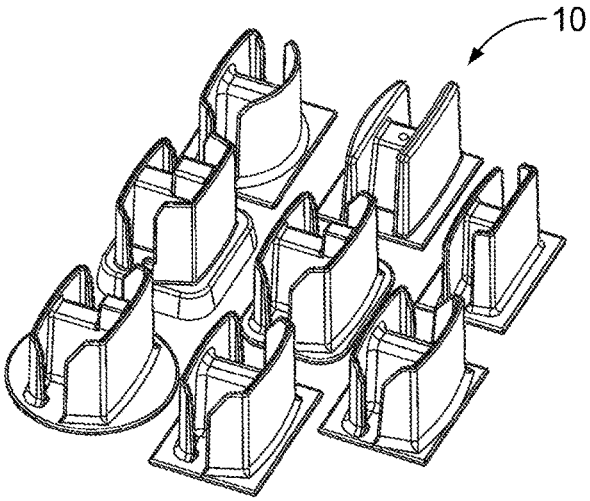

As shown in FIGS. 2A-2C, a first segment 102 can angle downward from a second segment 103, the first segment 102 communicating with or joining a depression or recess 66 of the front retaining wall 56.

Each retaining wall 56 and 58 can have a top surface 62 and a bottom surface 60 opposite the top surface 62, with a pair of lateral surfaces or walls 68, each lateral wall 68 extending between (and joining or connecting) the top and bottom surfaces 62, 60. As shown in FIG. 2D, the retaining walls 56 and 58 can terminate at their lateral surfaces 68.

As shown in FIGS. 3A-3C, each retaining wall 56 and 58 can include supplemental walls 70 attached to and communicating with one or more of the lateral walls 68. The supplemental wall 70 can attach to the base member 20 and extend upward from the base member 20.

In general, each supplemental wall 70 can be made of one or more sections 77. Where there is a plurality of sections 77, a first proximal section 78 can connect the supplemental wall 70 to the retaining wall 56 and 58, while the other distal sections 79 (located more distal to the retaining wall 56 and 58 than the proximal section 78) can extend outward from the first proximal section 78. For example, the supplemental wall 70 can include a first proximal section 78 having one end connected or joined to the retaining wall 56 and 58, and an opposite end connected or joined to a first distal section 79; the first distal section 79 can be connected or joined to the proximal section 78 on one end and have an opposite end connected to a second distal section 79, and so on, for as many distal sections 79 that the supplemental wall 70 possesses.

Each section 77 can define a generally planar surface, with a bottom edge 151 attached to the base member 20 and a top edge 153 opposite the bottom edge 151. Lateral edges 155 can be located between the bottom and top edges 151, 153. Each section 77 can include an interior surface 157 facing toward the bridge supporting member 80 and an exterior surface 159 facing away from the bridge supporting member 80. The top edge 153 of each section 77 can define a flat or planar surface. It is preferred that the top edge 153 of each successive section 79 slope i) further away from the retaining wall 56 and 58 to which it is connected or joined and/or ii) further downward toward the base member 20, compared to preceding sections 79. However, the top edge 153 of a section 77 can define a horizontal surface (parallel to the upper surface 24 of the base member 20 and/or the upper surface 82 of the bridge supporting member 80) for engaging and orienting a portion of the eyeglass 301. For example, as shown in FIGS. 3A and 3C, the most distal section 79 of the front supplemental wall 161 can have a top edge 153 with a horizontally-oriented or horizontally-facing surface that can support a portion of an eyeglass 301. In another example, the most distal section 79 of the front supplemental wall 161 can have a top edge 153 with a surface that can angle downward toward the base member 20, providing a top edge 153 that can guide the eyeglass 301 to be secured within in the device 10. The outer edges 71 of the most sections 77 can provide a supplemental wall 70 with a downward and inward angle for guiding the eyewear to engage the base member 20 and the opposite retaining wall 56 and 58.

Each section 77 can be set at an angle to each neighboring section 77 attached to it. It is preferred that the sections 77 together, can define a structure generally extends away from the bridge supporting member 80 and/or away from toward the opposite side of the device 10. The sections 77 together can define a supplemental wall 70 (or a matching pair of supplemental walls 70 for each retaining wall 56 and 58) that angles or curves away from the retaining wall 56 and 58, to encircle or surround the eyewear 301.

In general, the outline of exposed top surfaces 153 of the sections 77 can define a pathway for guiding a portion of an eyeglass 301 to communicate with the base member 20. The top surfaces 153 can define a stepwise path between the top wall 62 of the connected retaining wall 56 and 58 and the base member 20; the top surfaces 153 can define an angled path between the top wall 62 of the connected retaining wall 56 and 58 and the base member 20.

Where a retaining wall 56 and 58 has one supplemental wall 70, it is preferred that the retaining wall 56 and 58 has a pair of supplemental walls 70. Where a retaining wall 56 and 58 has a pair of supplemental walls 70, it is preferred that the supplemental walls 70 be mirror images of each other. In contrast, where both the front and back retaining walls 56, 58 have supplemental walls 70, it preferred that the supplemental walls 70 of the front retaining wall 56 be mirror images of each other, and the supplemental walls 70 of the back retaining wall 58 be mirror images of each other, but the pairs of supplemental walls 70 not be mirror images of each other.

Where one only retaining wall (e.g., front retaining wall 56) has a pair of supplemental walls 70, each supplemental wall 70 and opposite retaining wall (e.g., back retaining wall 58) can define a pocket or slot 116 for receiving a portion of the frames 303 and/or lenses 305 of the eyeglass 301. The slot 116 can be positioned perpendicular or transverse to the bridge supporting member 80.

Where both retaining walls 56, 58 have pairs of supplemental walls 70, the pair of front supplemental walls 161 and the pair of back supplemental walls 163 can define a pair of pockets or slots 116 for receiving a portion of the frames 303 and/or lenses 305 of the eyeglass 301

Each pocket or slot 116 can define a generally V-shaped or U-shaped profile in the lateral sides 13 of the device 10 (when viewed from a side perspective). The slot 116 can be defined by the outer edges 71 of the supplemental walls 70 defining a lateral edge of the slot 116, and the upper surface 24 of the base member 20 extending between the supplemental walls 70 to define the bottom edge of the slot 116. This slot 116 can provide a channel that passes through a lateral side 13 of the device 10. As shown in FIGS. 3A and 3C, the bridge supporting member 80 can separate a slot 116 defined in each lateral side 13 of the device 10.

In some embodiments, a bridge supporting member 80 can extend between the retaining walls 56 and 58, such that the front and back retaining walls 56, 58 lack inner sides facing each other.

In some embodiments, the bridge supporting member 80 can extend between upper portions (or the top ends 62) of the front and back retaining walls 56, 58. The bridge supporting member 80 can define a depressed segment or groove 66 positioned between the retaining walls 56 and 58, the depressed segment 66 running generally parallel to one or both retaining walls 56 and 58. The groove 66 can be positioned equidistant from each retaining wall 56 and 58, that is, located at a midpoint between the front retaining wall 56 and the back retaining wall 58. The groove 66 can be positioned closer to one retaining wall 56 and 58 than the other retaining wall 56 and 58. For example, in FIG. 5E, the groove 66 can be positioned closer to the back retaining wall 58 so as to provide a resting place for the crossed-over temples 311 of the eyeglass 301 and allow the folded temples 311 to communicate with the groove 66. This configuration can also facilitate positioning of the crossed-over temples 311 between the front and back retaining walls 56, 58, particularly while the bridge 307 is supported by the a tapering ridge on the upper surface 82 of the bridge supporting member 80.

The eyeglass 301 can be supported by the upper surface 82 of the bridge supporting member 80, with the bridge 307 or nosepiece of the frame 303 resting on the upper surface 82. The upper surface 82 can comprise a point upon which the bridge 307 of the eyeglass 301 can rest. The upper surface 82 can comprise a generally flat or planar surface upon which the eyeglass 301 can rest; in preferred embodiments, the upper surface 82 can have a width (along a plane perpendicular to a longitudinal central axis of the top surface 82 between 0.100 inches to 1.25 inches, to accommodate a variety of glasses 301. The upper surface 82 can have an outer surface that is flat, smooth, rough, or textured. The shape or contour of the upper surface 82 can be concave or convex. In other embodiments, a flat or curved upper surface 82 can similarly support such structures of the eyeglass 301.

Where the bridge supporting member 80 is generally triangular or trapezoidal in cross-section (through a plane perpendicular to a central longitudinal axis of the bridge supporting member 80), the side walls 92 can include straight surfaces that extend downward and outward from the upper surface 82 toward the base end 84. The surfaces of the side walls 67 (positioned between the upper and lower surfaces 82, 84) can be curved to give the side walls 67 a convex or concave upper surface portion. The surfaces of the side walls 67 can be curved or shaped to mimic the outer peripheral edges 313 of eyeglass lenses 305, to increase the surface area of the points of contact between the bridge supporting member 80 and the lens 305, thus strengthening the degree of support the that the eyewear holder 10 provides to the eyeglass 301.

The side walls 67 can extend outward in a stepwise fashion from upper surface 82 to base end 84, where each successive step extends further outward than its predecessor step. The surfaces of the side walls 67 can be smooth, rough, or textured.

Where the bridge supporting member 80 has side walls 67 that slope outward from the upper surface 82 (and toward the base end 84), those side walls 67 can provide support for a portion of the lenses 305. That is, the bridge supporting member 80 can support a portion of the periphery 313 of an eyeglass lens 305, particularly a portion of the bottom of the lenses 305 and/or a portion of the side joining the bridge 307 or nosepiece of the eyeglass 301.

The bridge supporting member 80 can position that retaining walls relative to each other to define a space of a size to accommodate a folded pair of eyeglasses 301.

Taken together, the bridge supporting member 80 and the retaining walls 56 and 58 can define a saddle-shape, with the top surface 82 containing the saddle point of the saddle.

As particularly shown in FIGS. 1-2, the eyewear holder 10 can be adapted to numerous embodiments.

Embodiment 1

In a first embodiment, as shown in FIGS. and 7, the eyewear holder 10 can include a base member 20, retaining walls 56 and 58, and a bridge supporting member 80 that separates and joins the retaining walls 56 and 58. These structures can be configured or joined together so that the upper surface 82 of the bridge supporting member 80 is planar or flat, and can define a plane that is substantially perpendicular to a plane defined by the inner surface 52 of one retaining wall 56 and 58 or both retaining walls 56, 58. The upper surface 82 of the bridge supporting member 80 can be substantially parallel to the upper surface 24 of the base member 20.

Where the first retaining wall 56 possesses a flat or planar upper surface 52, the bridge supporting member 80 can have a height shorter than, equal to, or greater than the first retaining wall 56. Where the second retaining wall 58 possesses a flat or planar upper surface, the bridge supporting member 80 can have a height shorter than, equal to, or greater than the second retaining wall 58. In these cases, it is preferred that the bridge supporting member 80 be shorter than both retaining walls 56, 58.

It is preferred that each of the opposite ends 86, 88 of the bridge supporting member 80 connect with an inner surface 52 of a retaining wall 56 and 58, defining a central axis of the retaining wall 56 and 58. That central axis can be located in a central portion 51 of the retaining wall 56 and 58; for example, located midway between the lateral walls 68 of the retaining wall 56 and 58 or the central axis can be located perpendicular to the base member 20. It is preferred that the bridge supporting member 80 defines a line that can bisect a retaining wall 56 and 58.

A cross-section of the bridge supporting member 80, taken through a plane parallel to an upper or lower surface 62, 60 of a retaining wall 56 and 58, can have a substantially rectangular or square shape. Here, the lateral sides 92 of the bridge supporting member 80 can form a right angle with the upper surface of the base member 20. The lateral sides 92 can form an acute angle $\alpha$ with the upper surface of the base member 20, the acute angle being less than 20 degrees, or less than 15 degrees, or less than 10 degrees, or preferably less than 5 degrees, or more preferably less than 2 degrees, or even more preferably about 1 degree.

A cross-section of the bridge supporting member 80, taken through a plane parallel to an upper or lower surface of a retaining wall 56 and 58, can have a substantially trapezoidal or triangular shape. Here, the lateral sides 92 of the bridge supporting member 80 can form a right angle with the upper surface of the base member 20. The lateral sides 92 can form an angle $\alpha$ with the upper surface of the base member 20, the angle being between 0 and 90 degrees, or between 10 and 80 degrees, or between 20 and 70 degrees, or between 30 and 60 degrees, or between 40 and 50 degrees, or about 45 degrees.

The retaining walls 56, 58 can have the same or similar heights, with respect to each other, as shown in FIG. 2C. As shown in FIGS. 7A-7D, the back retaining wall 58 can have a greater height than the front retaining wall 56. The inner surface 52 of the front retaining wall 56 can provide a surface for engaging a front portion of the frame 303 or lenses 305 of an eyeglass 301. The inner surface 52 of the back retaining wall 58 can provide a surface for engaging a back portion of the frame 303 or lenses 305 or the folded temples 311 of the eyeglass 301. The top and lateral surfaces 82, 92 of the bridge supporting member 80 can engage bottom portions of the bridge 307 or frame 303. A portion of the lenses 305 or frame 303 can engage the top surface 24 of the base member 20.

Embodiment 2

In a second embodiment, as shown in FIGS. 4-6, and 8, the eyewear holder 10 can include a base member 20, retaining walls 56 and 58, and a bridge supporting member 80 that separates and joins the retaining walls 56 and 58. These structures can be configured or joined together so that the upper surface of the bridge supporting member 80 is curved.

Viewed in a cross-section through a central longitudinal axis of the bridge supporting member 80, the upper surface 82 of the bridge supporting member 80 can define a downwardly-curving U-shaped curve or downwardly-pointing V-shaped path, having the low point or valley in a central region 96 of the upper surface 82. That is, the lowest point of the U-shaped curve or V-shaped path can be located between the retaining walls 56, 58, preferably at the midpoint between the retaining walls 56, 58. The lowest point of the U-shaped curve or V-shaped path can include the portion of the path that is closest to the base member 20.

Each end 86, 88 of the bridge supporting member 80 can extend to the upper surface 62 or top end of a retaining wall 56 and 58, and attach to the retaining wall 56 and 58 at that juncture. Each end 86, 88 of the bridge supporting member 80 can join or attach to an inner surface 52 of a retaining wall 56 and 58, preferably at a central portion 51 of the retaining wall 56 and 58.

Figure 6A:
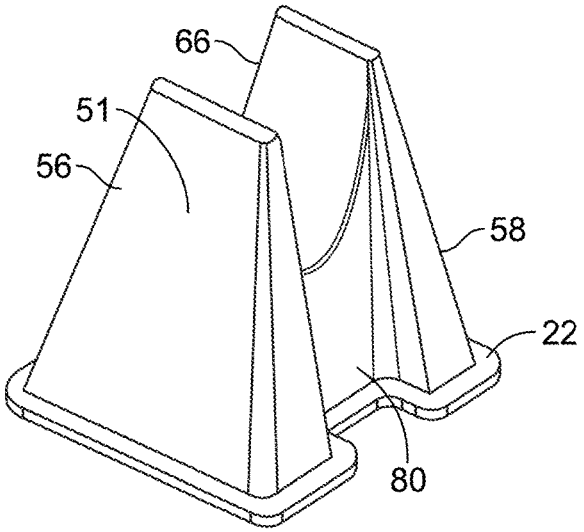
FIGS. 6A-6D show views of an embodiment of an eyewear holder; a perspective view (FIG. 6A), a side view (FIG. 6B), and a top perspective view (FIG. 6C) of the eyewear holder, and a perspective view of the eyewear holder holding eyewear (FIG. 6D)
Figure 6B:
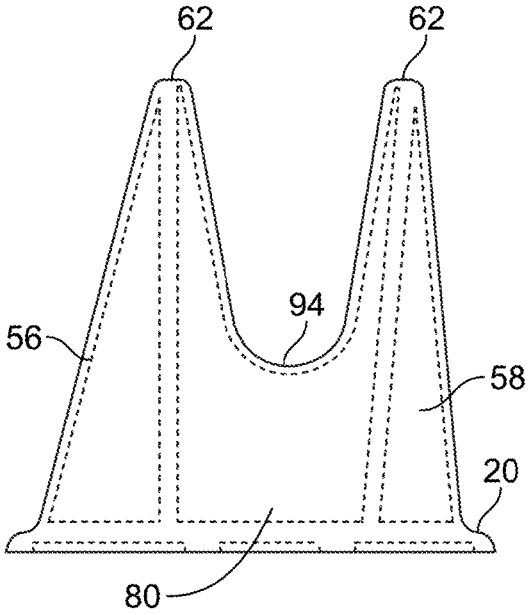
Figure 6C:
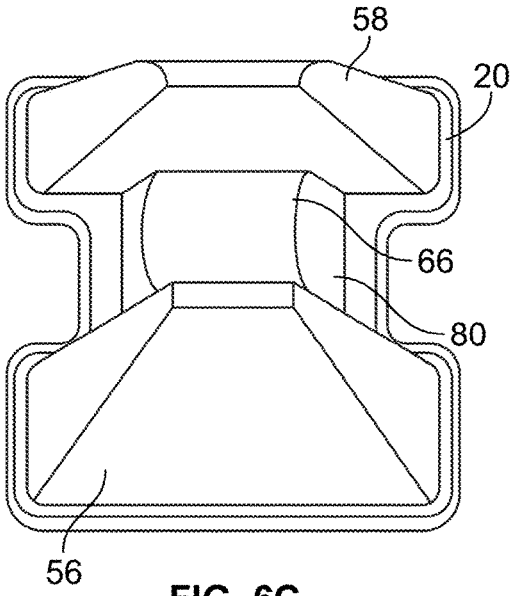
Figure 6D:
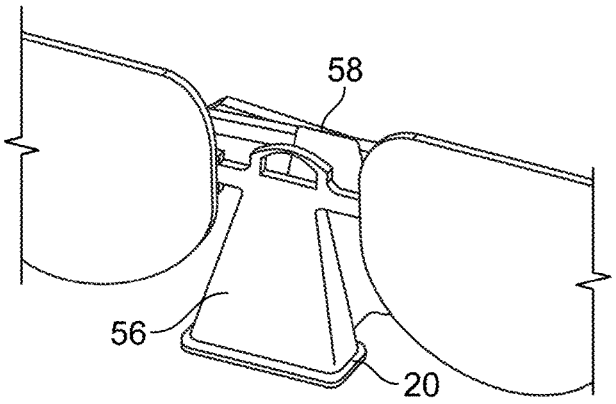

When the eyeglass 301 is engaged in the device 10, a central portion of the eyeglass 301 can be positioned into contact with the central portion 96 of the bridge supporting member 80, in the lowest point of the curved bridge supporting member 80. A portion of the lenses 305 or frame 303 can engage the top surface 24 of the base member 20. The temples 311 can be folded and retained between the front and back retaining walls 56, 58 (FIGS. 8A-8C), or the temples 311 can extend past the back retaining wall 58 (FIG. 4B) or fold to contact the outer surface 54 of the back retaining wall 58 (FIG. 6D).

Embodiment 3

In a third embodiment, as shown in FIG. 9, the eyewear holder 10 can include retaining walls 56 and 58 and a bridge supporting member 80 that separates and joins the retaining walls 56 and 58. Unlike Embodiments 1 and 2, the retaining walls 56 and 58 and bridge supporting member 80 do not attach to a base member 20. Instead, a first retaining wall 56 can be attached to one end 86 of the bridge supporting member 80, and a second retaining wall 58 can be attached to an opposite end 88 of the bridge supporting member 80.

The bridge supporting member 80 can define an elongated portion 90 extending between the first and second retaining walls 56, 58.

The device 10 can be a hollow structure or a solid one. The structures can include a continuous or contiguous peripheral border 21 or flange 22 extending outward from them. That flange 22 can have a uniform width as it extends outward from the bottom, outer edges of the retaining walls 56 and 58 and bridge supporting member 80. While it is preferred that such flange 22 define a continuous surface of uniform width, that flange 22 can include cutouts or interruptions and that flange 22 can include varying widths at different points around the device 10.

As shown in FIG. 9, the bridge supporting member 80 can have an upper surface 82 composed of multiple segments 98 that connect to each other in a linear fashion to define an elongated portion 90 spanning between the front and back retaining walls 56, 58. Each segment 98 can have an elevation or orientation different than its immediately-neighboring segment on either side. For example, neighboring segments 102-104 can connect so that they define an angle or curve when viewed from a side perspective.

A first segment 102 can connect to a second segment 103, which can connect a third segment 104, and so on for as many segments as are present. The last segment (e.g., 104) can define a surface that is proximate to the top surface 62 of the back retaining wall 58. Each segment can communicate with a portion or the eyeglass 301 when it is engaged in the device 10, or not communicate with a portion of the eyeglass 301.

The multiple segments 102-104 can define a step-like structure, having the greatest height at the segment (e.g., 104) connecting to the back retaining wall 58 and its lowest height at the segment (e.g., 102) connecting to the front retaining wall 56. When an eyeglass 301 is placed within the eyewear holder 10, lower portions of the bridge 307 and/or inner portions of the lenses 305 can communicate with the first segment 102, while the second segment 103 can support the back side of the frame 303, bridge 307, and/or lenses 305. The third segment 104 does not directly contact the eyeglass 301 when the eyeglass 301 is engaged in the device 10.

As shown in FIG. 3A, the first segment 102 can be proximate to the top surface 62 of the front retaining wall 56. The top surface 62 of the front retaining wall 56 can extend above the height of the first segment 102, for communicating with a front portion of the eyeglass 301 and helping to keep the eyeglass 301 in a substantially upright position within the device 10. The third segment 104 can be proximate to the top surface 62 of the back retaining wall 58.

The second segment 103 can define a vertical or curved or angled surface that can engage a back portion of the eyeglass 301 when engaged within the device 10. The second segment 103 be positioned on or near a plane defined by the outer edges 71 of the back supplemental walls 163 extending from the back retaining wall 58.

The second segment 103 and the outer edges 71 can define the back boundary or edge of the slot 116 into which the eyeglass 301 is placed when inserted into the device 10. The front boundary or edge of the slot 116 can be defined by the lateral edges 68 of the front retaining wall 56. The front boundary or edge of the slot 116 can be defined by the outer edges 71 of the front supplemental walls 161 attached to the front retaining wall 56.

Each retaining wall 56 and 58 can include supplemental walls 70 attached to and communicating with one or more of the lateral walls 68. The front retaining wall 56 can have a front supplemental wall 161 attached to a lateral side 68 of the front retaining wall 56. The back retaining wall 58 can have a back supplemental wall 163 attached to a lateral side 68 of the back retaining wall 58.

Each front and back supplemental wall 161, 163 can be made of one or more sections 77. A first proximal section 78 can connect the supplemental wall 70 to the retaining wall 56 and 58, while the other distal sections 79 (located more distal to the retaining wall 56 and 58 than the proximal section 78) can extend outward from the first proximal section 78. The first distal section 79 can be connected or joined to the proximal section 78 on one end and have an opposite end connected to a second distal section 79, and so on, for as many distal sections 79 that the supplemental wall 70 possesses.

The front supplemental walls 161 can extend from the front retaining wall 56 toward the lateral sides 13 and/or the back retaining wall 58. The back supplemental walls 163 can extend from the back retaining wall 58 toward the lateral sides 13 and/or the front retaining wall 56.

Each section 77 can define a generally planar surface, with a bottom edge 151 attached to the base member 20 and a top edge 153 on the opposite side. Lateral edges 155 can be located between the bottom and top edges 151, 153. Each section 77 can include an interior surface 157 facing toward the bridge supporting member 80 and an exterior surface 159 facing away from the bridge supporting member 80.

The top edge 153 of each section 77 can define a flat or planar surface, although curved or irregularly shaped surfaces are also envisioned. It is preferred that the top edge 153 of each successive section 79 slopes away from the retaining wall 56 and 58 to which it is connected or joined and/or slopes toward the base member 20, compared to preceding sections 79. However, the top edge 153 of a section (e.g., 76) can define a horizontal surface for engaging and orienting a portion of the eyeglass 301. The most distal section 79 of the front supplemental walls 161 have a horizontal top edge 153 (parallel to the base member 20 or perpendicular to the retaining walls 56 and 58) for supporting a portion of an eyeglass 301.

On each lateral side 13 of the device 10, the outer edges 71 of the supplemental walls 161, 163 can define a slot 116 into which a portion of the frames 303 and/or lenses 305 of the eyeglass 301 can be inserted. Each pocket or slot 116 can define a V-shaped or U-shaped profile in the lateral sides 13 of the device 10 (when viewed from a side perspective). The slot 116 can be defined by the outer edges 71 of the supplemental walls 161, 163 defining a lateral edge of the slot 116, and the upper surface 24 of the base member 20 extending between the supplemental walls 70 defining the bottom edge of the slot 116. This slot 116 can provide a channel that passes through a lateral side 13 of the device 10. The bridge supporting member 80 can separate a slot 116 defined in each lateral side 13 of the device 10.

When an eyeglass 301 is placed into the eyeglass holder 10, multiple surfaces of the device 10 can engage different portions of the eyeglass 301, to position the eyeglass 301 in a substantially vertical orientation and to keep the eyeglass 301 in a substantially vertical or upright orientation. The eyeglass 301 can be positioned to straddle the bridge supporting member 80, with the frame 303 and/or lenses 305 positioned between the retaining walls 56 and 58.

The bridge 307 can contact the bridge supporting member at one or more locations. Portions of the frame 303 and/or lenses 305 can contact the lateral sides 92 of the bridge supporting member 80; other portions of the frame 303 and/or bridge 307 can contact the top surface 82 of the bridge supporting member 80. For example, a bottom portion of the bridge 307 can contact the first segment 102, while a rear portion of the bridge 307 can contact the second segment 103.

The temples 311 can be placed between the retaining walls 56 and 58 or extend past the back retaining wall 58 or fold to contact the outer surface 54 of the back retaining wall 58. A bottom portion of the frame 303 and/or lenses 305 can contact the top surface 24 of the base member 20.

A portion of the frame 303 and/or each lens 305 can be inserted into the slot 116 on either side of the bridge supporting member 80. The front supplemental walls 161 can contact a front portion of the lenses 305. The back supplemental walls 163 can contact a back portion of the lenses 305.

Embodiment 4

As shown in FIG. 10, device can comprise a base member 20 whose upper surface 24 is joined to a bridge supporting member 80. The bridge supporting member 80 can divide the base member 20 into two sections along a central axis of the base member 20 or the device 10. The peripheral border 21 of the base member 20 connect to a flange 22 depending downward from the base member 20, the flange 22 having a continuous height as it surrounds the base member 20.

The bridge supporting member 80 can have a bottom surface 26 joined to the top surface 24 of the base member 20, the bottom surface 26 oriented along the central axis of the base member 20 or the device 10. The bridge supporting member 80 can have a top surface 24 also oriented along the same central axis. A front end 86 of the bridge supporting member 80 can be proximate to a front retaining wall 56 while an opposite back end 88 of the bridge supporting member 80 can be proximate to a back retaining wall 58. In other embodiments, the ends of the bridge supporting member 80 can be indirectly connected or directly adfixed to the front and back retaining walls 56, 58.

The top surface 82 of the bridge supporting member 80 can have a first width, and the bottom surface 84 can have a second width that is less than the first width. The lateral sides 92 of the bridge supporting member 80 can extend outward and downward from the top surface 82 to the bottom surface 84, so that the lateral sides 92 attach to the base member 20 at a transverse angle. Viewed from the front, the bridge supporting member 80 can have a trapezoidal profile or shape, having a narrower top side 82 and a broader bottom side 84 (with respect to each other).

Figure 10A:
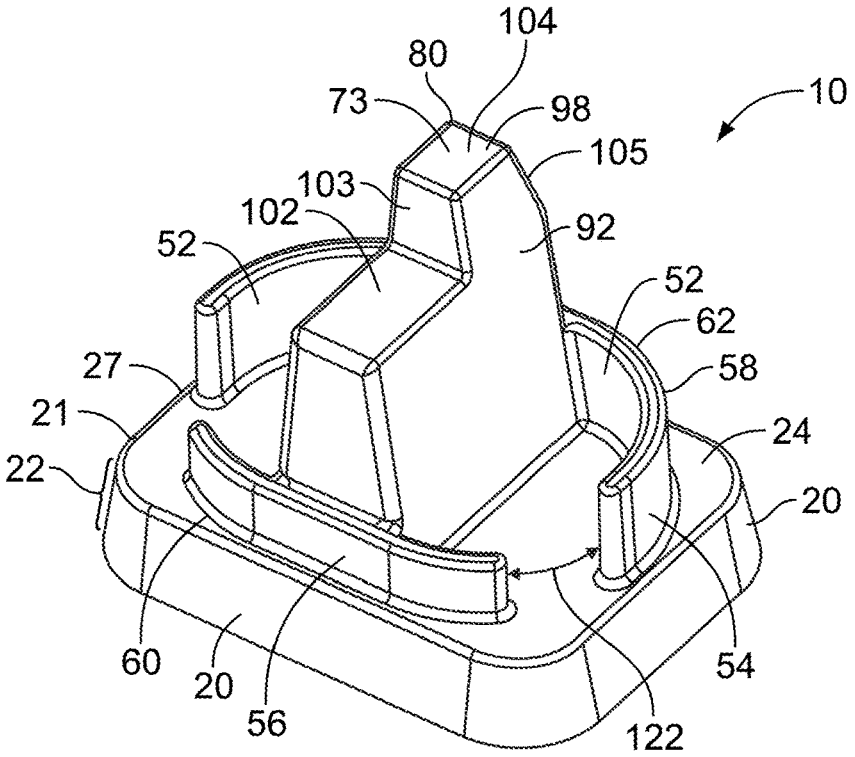
FIGS. 10A-10D show views of an embodiment of an eyewear holder.
Figure 10B:
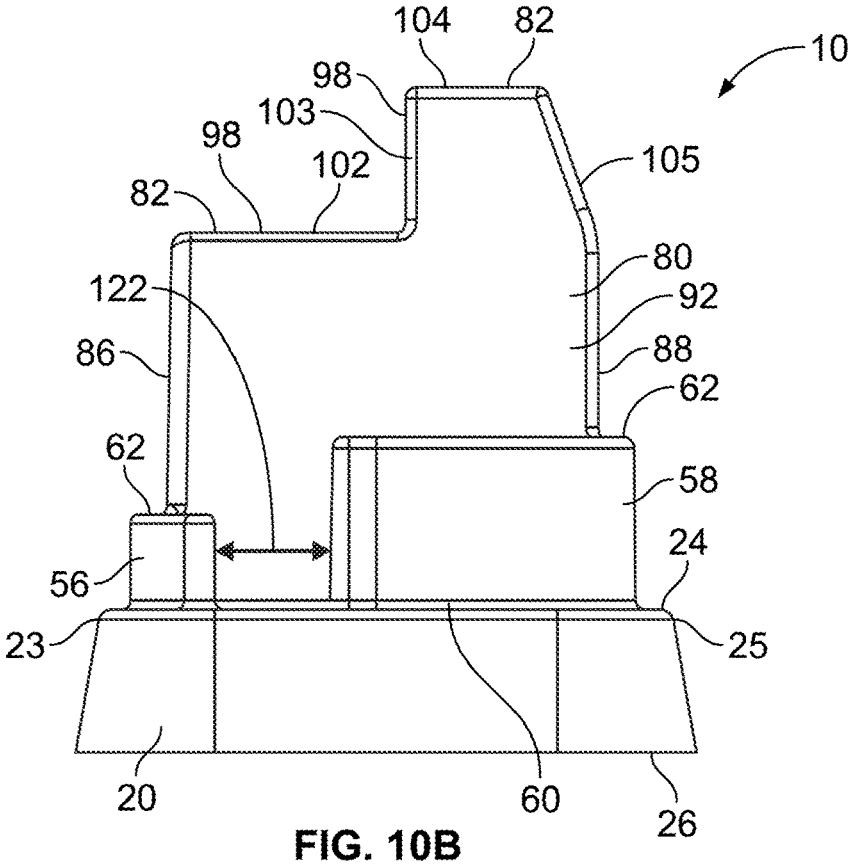
Figure 10C:
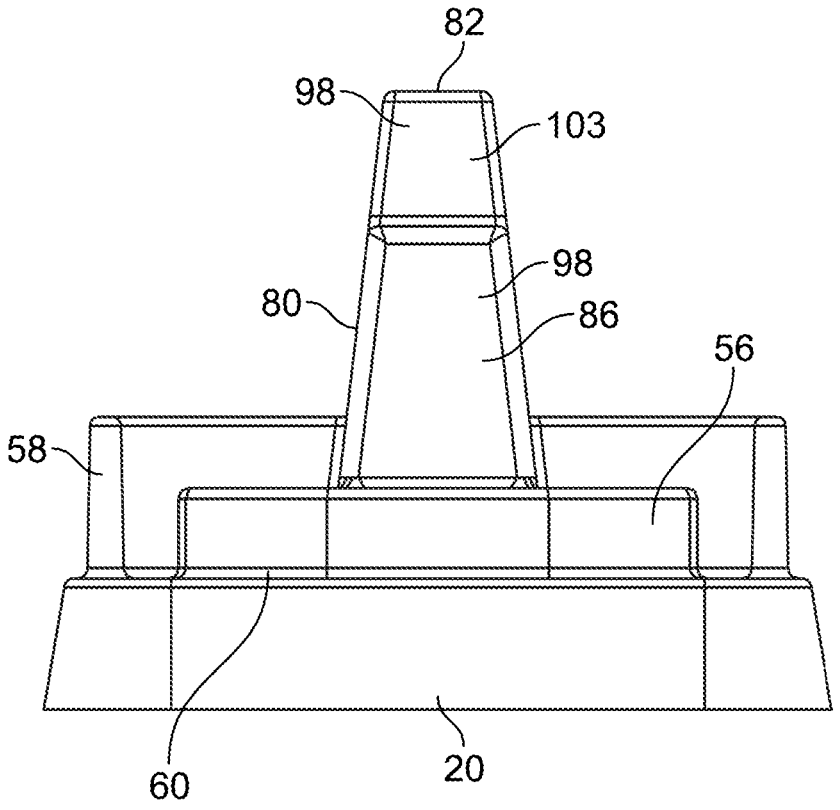
Figure 10D:
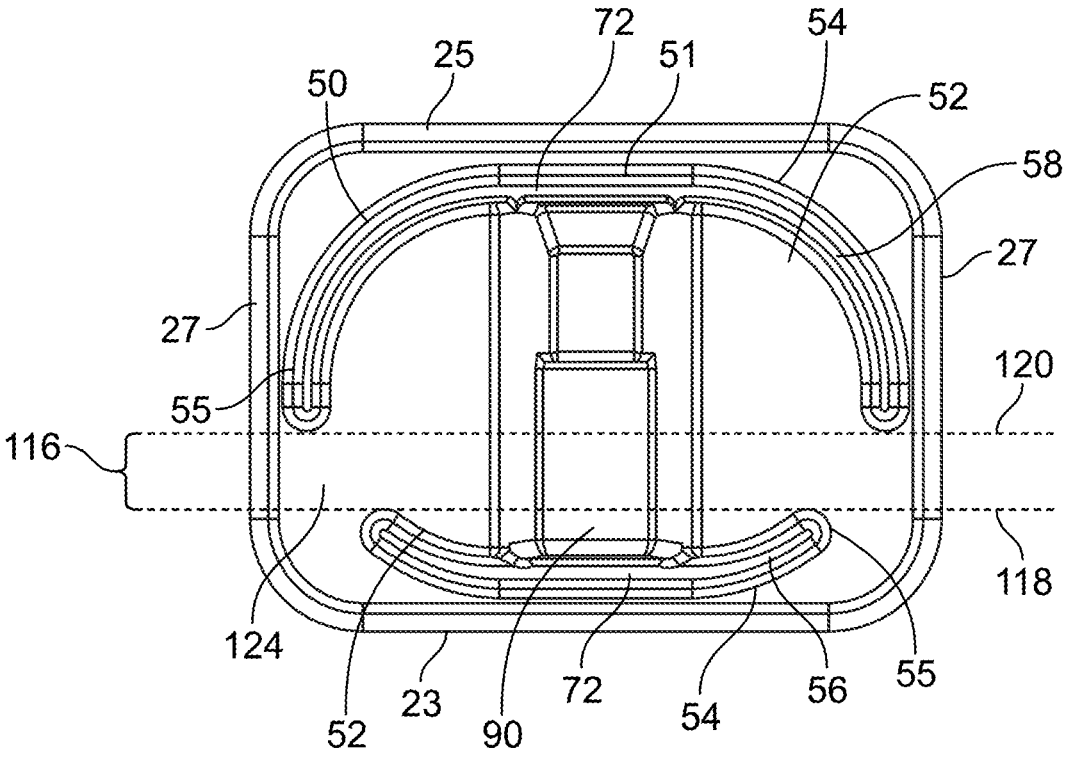

As shown in FIGS. 10A-10B, the segments 98 of the top surface 24 can be located at a height greater than that of the front and back retaining walls 56, 58. The front retaining wall 56 can have a height that is less than the height of the back retaining wall 58, while both retaining walls 56, 58 have heights less than the top surface 24 of the bridge supporting member 80.

The bridge supporting member 80 can include an elongated portion 90 extending between the front and back retaining walls 56, 58. That elongated portion 90 can include a series of flat, planar segments (e.g., 102-106), each segment (e.g., 103) connected to one or more neighboring segments (e.g., 102, 104). As shown in FIGS. 10A-10B, neighboring segments can connect so that they define an angle between them; that is, so that neighboring segments are not located on a common plane.

The first segment 102 can extend from the front retaining wall 56, along with successive second, third, and fourth segments, respectively, with the fourth segment attaching to the back retaining wall 58. The first and third segments 102, 104 can define planes that are oriented parallel to each other, but positioned at different heights so that their planes do not intersect. The third segment 104 can be located at a higher elevation than the first segment 102, when the device 10 is in an upright position. The second segment 103 can define a plane that is perpendicular to the planes defined by the first and third segments 102, 104. The first three segments 102-104 can define a step-like structure, with the first segment 102 defining lowest step. The fourth segment 105 can define a transverse plane between the top surface 24 and the back end of the bridge supporting member 80, providing the bridge supporting member 80 with a chamfered back end 88.

Where the lateral walls 92 are set at a transverse angle to the base member 20 (rather than set to be perpendicular to the base member 20), the segments set in a horizontal orientation (or set in a plane parallel to the base member 20) can have a rectangle outline or shape (e.g., first and third segments 102, 104). The segments set in a perpendicular or transverse orientation with respect to the base member 20 (or arranged in a plane the intersects the base member 20 at a right or transverse angle) can have a trapezoidal shape (e.g., second and fourth segments 103, 105).

The front and back retaining walls 56, 58 can be arranged so that a central portion 51 of one retaining wall 56 and 58 is arranged parallel to a central portion 51 the other retaining wall 56 and 58. Each retaining wall 56, 58 can include end portions 55 that extend outward from the central portion 72 and curve inward toward the other retaining wall 56 and 58.

Specifically, the back retaining wall 58 can include a central portion 72 that is proximate to the back portion 25 of the base member 20 and can include end portions 55 each of which is proximate to a lateral side 28 of the base member 20; these end portions 55 can define a back side 120 of the slot 116 into which the eyewear 301 is inserted. The front retaining wall 56 can include a central portion 72 that is proximate to the front portion 23 of the base member 20 and can include end portions 55 each of which is proximate to a lateral side 28 of the base member 20; these end portions 55 can define a front side 118 of the slot 122 into which the eyewear 301 is inserted. The portion of the base member 20 between the end portions 55 of the back retaining wall 58 and the end portions 55 of the front retaining wall 56 can make up part of the bottom side 124 of the slot 122.

The slot 122 can be oriented to be transverse to (e.g., perpendicular to) the bridge supporting member 80. The slot 116 can have a front side 118 that is defined by the inner surface 52 of the front retaining wall 56. The slot 122 can have a back side 120 that is defined by the inner surface 52 of the back retaining wall 58. The lateral edges or sides of the slot 122 can be spaces or gaps between corresponding ends or lateral walls 68 of a front and back retaining wall 56, 58. That is the end portion 68 of the front retaining wall 56 and the closest end portion 68 or the back retaining wall 58 can define a gap 122 between them. Each slot gap 122 can hold a portion of the eyewear 301, preferably a portion of a lens 305. When the eyewear engages the bridge supporting member 80, such as straddling the bridge support member 80, a pair of slot gaps 122 can hold both lenses 305 and restrict the forward, backward, and rotational movement of the eyewear 301 while it is in the device.

In some other embodiments, the front and back retaining walls 56, 58 can be mirror images of each other. Here, the central portion 51 of the back retaining wall 58 can have a length that is longer than the length of the central portion 51 of the back retaining wall 58. Here, the end portions 55 of the back retaining wall 58 can have a length that is longer than the length oft the end portions 55 of the back retaining wall 58. When viewed from the front or rear, the back retaining wall 58 can have a length that is greater than a length of the front retaining wall 56. Where these differences in retaining wall 56 and 58 length exist, the gap between the end portions 55 back and front retaining wall that are proximate to the same lateral side 28 of the base member 20 can define a gap having a sufficient length in which to position a portion of an eyeglass 301.

When an eyeglass 301 is placed within the eyeglass holder 10, the bridge 307 of the eyeglass 301 can be positioned to straddle the bridge supporting member 80. The eyeglass 301 can occupy the slot 116. When seated against the bridge supporting member 80, portions of the bridge 307 and/or inner portions of the lenses 305 can communicate with the first segment 102, while the second segment 103 can support the back side of the frame 303, bridge 307, and/or lenses 305. Inner portions of the lenses 305 can communicate with the lateral walls 92 of the bridge supporting member 80. Front portions of the lenses 305 can communicate with the end portions 55 of the front retaining wall 56, while the back portions of the lenses 305 can communicate with the end portions 55 of the back retaining wall 58. The ear pieces 311 can wrap around to communicate with the back surface 88 of the bridge supporting member 80 or with the outer surface 54 of the back retaining wall 58 or with a portion of the upper surface 24 of the base member proximate to the back end or side 25 of the base member 20, or the ear pieces 311 can simply extend away from the device 10. The eyewear 301 can communicate with the device 10 at some or all of these locations.

When the eyeglass straddles the bridge supporting member and adopts a substantially upright position, the first segment 102 can restrict the downward movement of the bridge 307, while the base member 20 can restrict the downward movement of the lenses 305 or frames 305. The front retaining wall 56 can restrict the forward movement of the eyeglass, the lateral walls 68 for contacting the fronts of the lenses 305. The back retaining wall 58 can restrict the backward movement of the eyeglass, the lateral walls 68 for contacting the backs of the lenses 305. The eyeglass can be seated with the slot gaps 122, to allow communication with the lateral ends 68 of the retaining walls 56, 58, thus restricting forward, backward, and rotational movement by the eyewear. The lateral walls 92 of the bridge supporting member 80 can communicate with inner portions of the lenses 305, thus restricting the side-to-side or sideward movement of the eyeglass 301.

The ear pieces 311 can wrap around to communicate with the back surface 88 of the bridge supporting member 80, or with a portion of the upper surface 24 of the base member proximate to the back end 25 of the base member 20, or the ear pieces 311 can simply extend away from the device 10.

Such restriction can immobilize the eyewear 301 within the device 10, or allow the eyewear to move to a degree, but not enough to change orientation from a vertical position to a horizontal position.

Embodiment 5

Figure 11A:
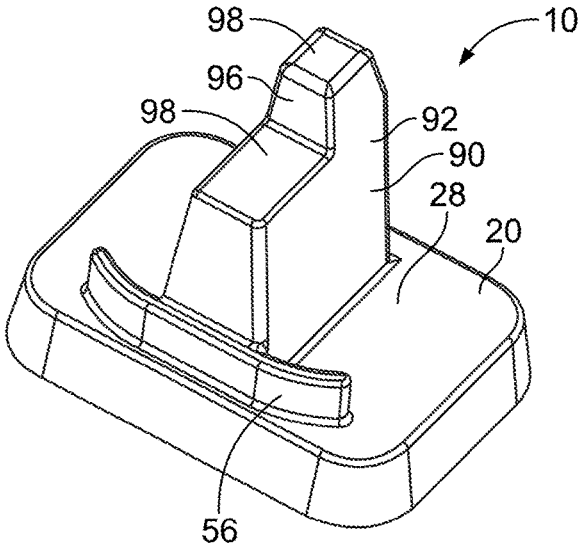
FIGS. 11A-11C show views of an embodiment of an eyewear holder.
Figure 11B:
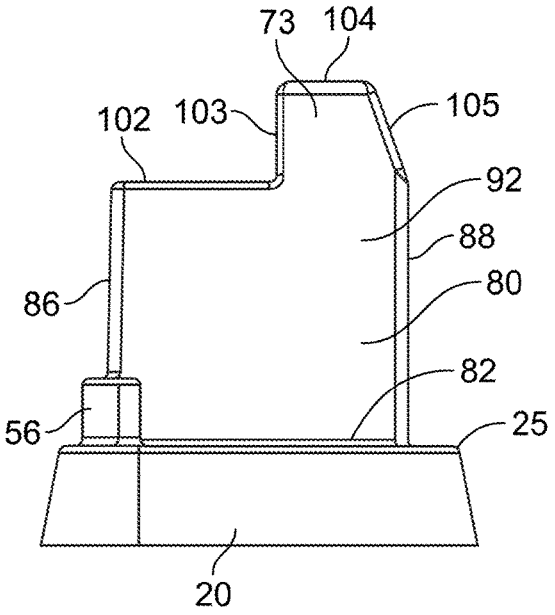
Figure 11C:
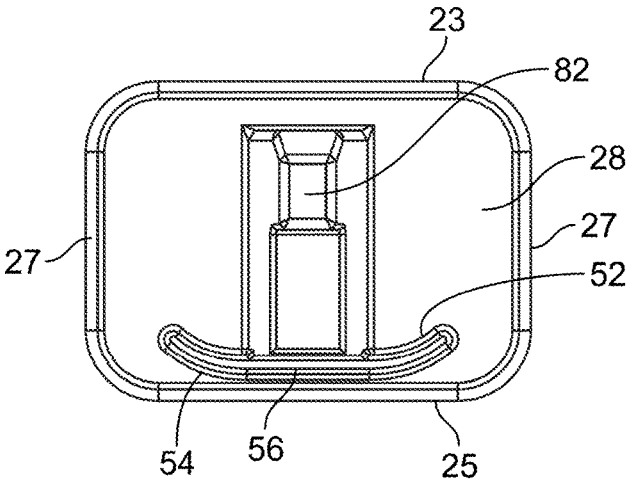
Figure 12A:
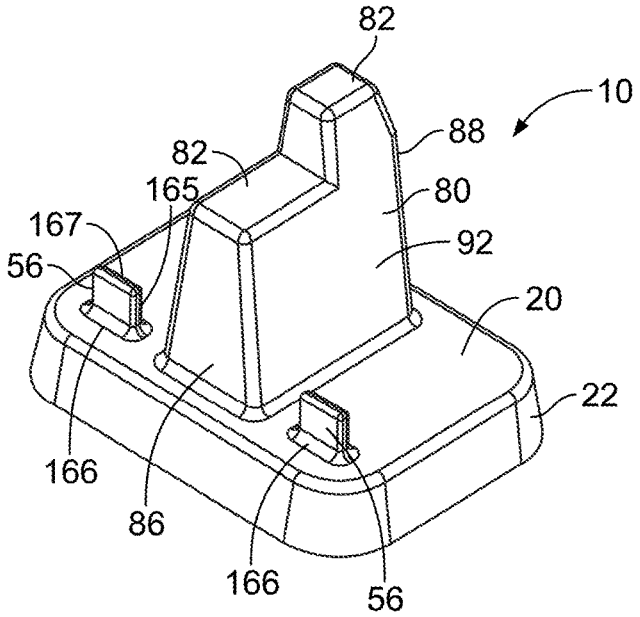
FIGS. 12A-12F show views of an embodiment of an eyewear holder.
Figure 12B:
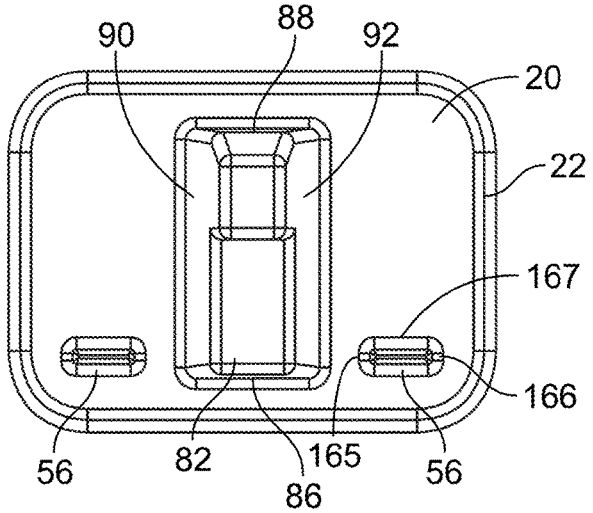
Figure 12C:
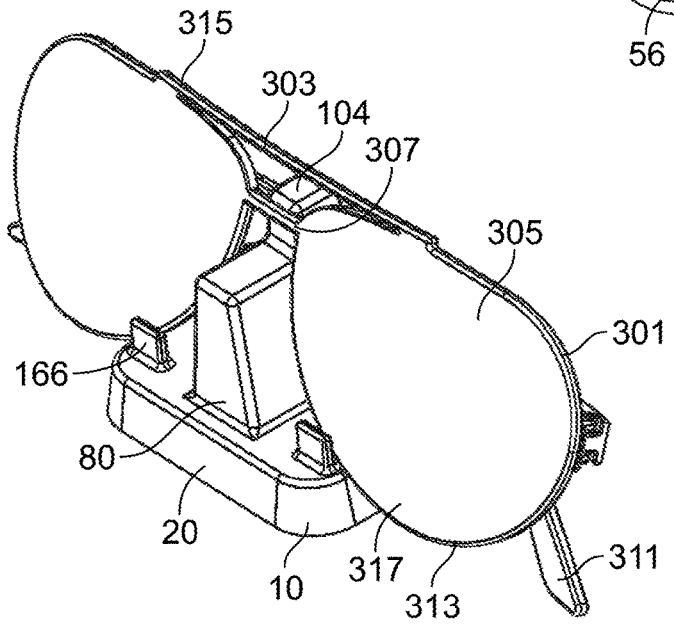
Figure 12D:
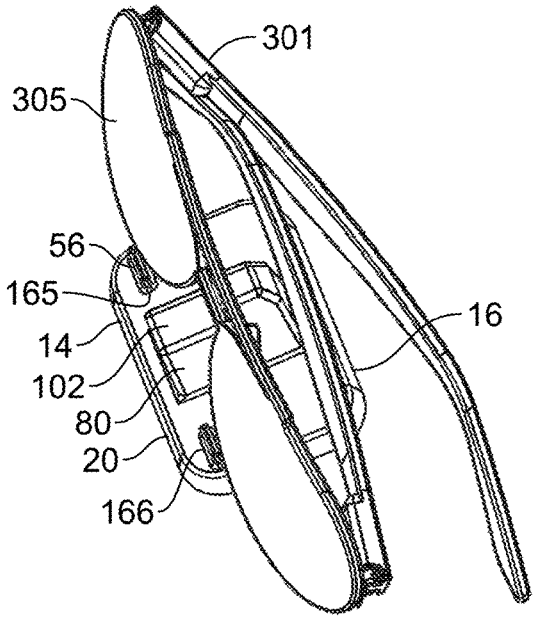
Figure 12E:
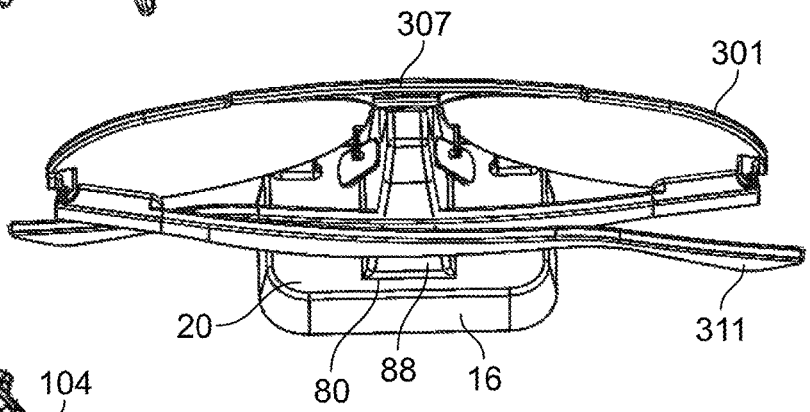
Figure 12F:
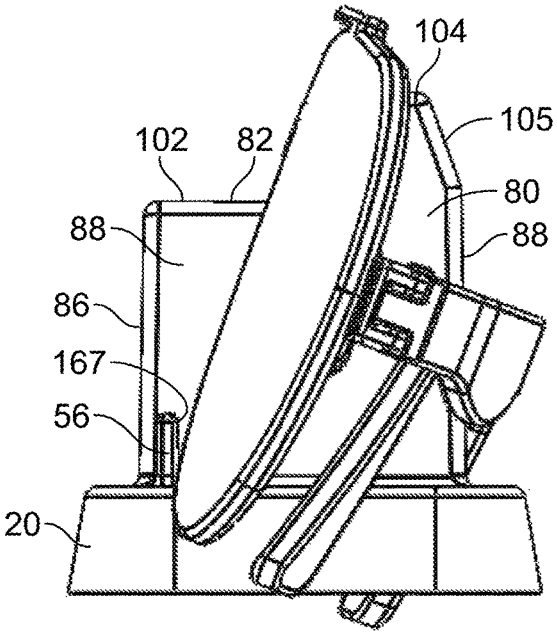

In some embodiments, as shown in FIG. 11, the device 10 can have a base member 20, bridge supporting member 80, and front retaining wall 56 as described in Embodiment 4, but lack the back retaining wall 58 described in that embodiment.

When an eyeglass 301 is placed within the eyewear holder 10, portions of the bridge 307 and/or inner portions of the lenses 305 can communicate with the first segment 102, while the second segment 103 can support the back side of the frame 303, bridge 307, and/or lenses 305. Inner portions of the lenses 305 can communicate with the lateral walls 92 of the bridge supporting member 80. Front portions of the lenses 305 can communicate with the end portions 55 of the front retaining wall 56. It is envisioned that the back portions of the lenses 305 will not directly communicate with the device 10. The ear pieces 311 can wrap around to communicate with the back surface 88 of the bridge supporting member 80, or with a portion of the upper surface 24 of the base member proximate to the back end 25 of the base member 20, or the ear pieces 311 can simply extend away from the device 10. The eyewear 301 can communicate with the device 10 at some or all of these locations.

When the eyeglass straddles the bridge supporting member and adopts a substantially upright position, the first segment 102 can restrict the downward movement of the bridge 307, while the base member 20 can restrict the downward movement of the lenses 305 or frames 305. The front retaining wall 56 can restrict the forward movement of the eyeglass. Together, the front retaining wall 56 and the first and second segments 102, 103 can restrict the rotational movement of the eyeglass 301. The lateral walls 92 of the bridge supporting member 80 can communicate with inner portions of the lenses 305, thus restricting the side-to-side or sideward movement of the eyeglass 301.

The ear pieces 311 can wrap around to communicate with the back surface 88 of the bridge supporting member 80, or with a portion of the upper surface 24 of the base member proximate to the back end 25 of the base member 20, or the ear pieces 311 can simply extend away from the device 10.

Such restriction can immobilize the eyewear 301 within the device 10, or allow the eyewear to move to a degree, but not enough to change orientation from a vertical position to a horizontal position.

Embodiment 6

In some embodiments, the device 10 can have a base member 20 and bridge supporting member 80, and front retaining wall 56 as described in Embodiment 4, but lack the back retaining wall 58 described in that embodiment.

In certain embodiments, as shown in FIG. 12, in place of a front retaining wall 56 made of a unitary piece, the front retaining wall can be made of two or more tabs 166 located on the front end or side 23 of the base member 20. The front tabs 166 can be arranged to define a linear structure for engaging the front portions of the lenses 305; in other embodiments the arrangement can be curved or angled. Together, the front tab 166 can define a barrier that restricts the forward movement of the eyewear 301 in the device.

The front surfaces 163 of the tabs can be located proximate to the front side 23 of the base member 20. Each front tab 166 can be for communicating with the front portion of the lenses 305 when the eyewear 301 is placed within the device 10. The front tabs 166 can be arranged to share the same plane as the front end 86 of the bridge supporting member 80, or to occupy a plane proximate to that defined by the front end 86 of the bridge supporting member 80.

Like the retaining walls 56 and 58 of other embodiments, the front tabs 166 can include planar surfaces extending upward from the upper surface 24 of the base member 20, and can be set perpendicular to the base member 20. Each tab can have one lateral end 165 proximate to the bridge supporting member 80 and the opposite lateral end 165 proximate to a lateral side 28 of the base member 20.

When an eyeglass 301 is placed within the eyewear holder 10, portions of the bridge 307 and/or inner portions of the lenses 305 can communicate with the first segment 102, while the second segment 103 can support the back side of the frame 303, bridge 307, and/or lenses 305. Inner portions of the lenses 305 can communicate with the lateral walls 92 of the bridge supporting member 80. Front portions of the lenses 305 can communicate with the back sides 167 of the tabs 166. The ear pieces 311 can wrap around to communicate with the back surface 88 of the bridge supporting member 80 or with a portion of the upper surface 24 of the base member proximate to the back end 25 of the base member 20, or the ear pieces can simply extend away from the device 10. The eyewear 301 can communicate with the device 10 at some or all of these locations.

Like the front retaining wall 56 can be made of a plurality of tabs 166 near one end of the device 10, yet other embodiments can have the back retaining wall 58 made up of one or more tabs 166 located proximate to the back end or side 25 of the base member 20 or proximate to another side of the base member 20.

When the eyeglass straddles the bridge supporting member and adopts a substantially upright position, the first segment 102 can restrict the downward movement of the bridge 307, while the base member 20 can restrict the downward movement of the lenses 305 or frames 305. The front retaining walls 56 can restrict the forward movement of the eyeglass, the inner surfaces 52 for contacting the fronts of the lenses 305. Together, the front retaining wall 56 and the first and second segments 102, 103 can restrict the rotational movement of the eyeglass 301. The lateral walls 92 of the bridge supporting member 80 can communicate with inner portions of the lenses 305, thus restricting the side-to-side or sideward movement of the eyeglass 301.

The ear pieces 311 can wrap around to communicate with the back surface 88 of the bridge supporting member 80, or with a portion of the upper surface 24 of the base member proximate to the back end 25 of the base member 20, or the ear pieces 311 can simply extend away from the device 10.

Such restriction can immobilize the eyewear 301 within the device 10, or allow the eyewear to move to a degree, but not enough to change orientation from a vertical position to a horizontal position.

Using the Eyewear Holder

The device 10 of this invention is simple to use. It can be placed in a stable, upright position on a flat, horizontal surface or mated to some other surface. The device 10 can also be mounted on a variety of other surfaces as explained below to secure eyewear 301 in a substantially upright, near vertical position. When the eyewear 301 is secured in the eyewear holder 10, the eyewear 301 can define a plane ("eyewear plane") that is substantially perpendicular to a plane defined by the base member 20, or the surface that the device 10 rests upon, or the ground ("base plane"). When the eyewear plane is not perfectly perpendicular to the base plane, then it is preferred that the intersection of the eyewear plane and the base plane define a angle between 0 degrees and 90 degrees, or between 0 and 60 degrees, or between 0 and 45 degrees, or between 30 and 30 degrees, or between 0 and 15 degrees, or between 0 and 10 degrees, or even more preferably between 0 and 5 degrees.

Similarly, the lenses 305 of the eyewear 301 can define a plane ("lens plane") that is substantially perpendicular to a plane defined by the base member 20, or the surface that the device 10 rests upon, or the ground ("base plane"). When the lens plane is not perfectly perpendicular to the base plane, then it is preferred that the intersection of the lens plane and the base plane define a angle between 0 degrees and 90 degrees, or between 0 and 60 degrees, or between 0 and 45 degrees, or between 30 and 30 degrees, or between 0 and 15 degrees, or between 0 and 10 degrees, or even more preferably between 0 and 5 degrees. In some such configurations, the temples 311 of the eyewear 301 can be folded to be tucked between a pair of retaining walls 56 and 58. In other configurations, the temples 311 can be manipulated to fold behind a back retaining wall 58 in at least one position, and manipulated so that the temples 311 do not directly contact the device 10 in other positions.

The eyewear holder 10 can have a base member 20 for supporting a first portion of the eyewear 301 (e.g., lenses 305), spaced-apart retaining walls 56 and 58 extending from the base member 20 for holding a second portion of the eyewear 301 (e.g., temples 311), and/or a bridge supporting member 80 connecting the retaining walls 56 and 58 and supporting a third portion of the eyewear (e.g., bridge 307). The bridge supporting member 80 can be specially modified for engaging different parts of the eyewear 301, such as the temples 311 or bridge 307 of the eyewear 301.

A pair of eyewear 301, indicated generally at FIGS. 3A-3C, 4B, 4D, 5G, 6D, 7A-7D, and 8A-8C, is disposed on the device 10. The eyewear 301 can include a frame 303 that includes a bridge 307 extending between pair of lenses 305, borders 309 surrounding the lenses 305, and temples 311 or ear pieces 311 extending rearwardly from lenses 305, as is well known in the art. The eyeglass 301 can include a frame 303 surrounding and containing the lenses 305.

As shown in FIGS. 3-8, the temples 311 of the eyeglass 301 can be folded inwardly and the eyeglass 301 is placed in the eyewear holder 10, with contact between the eyewear holder 10 and eyeglass 301 occurring at one or more of the following sites at about the same time: the bridge 307 being placed in communication with the upper surface 82 or lateral surfaces 92 of the bridge supporting member 80; the outer surfaces of the lenses 305 being placed in communication with the upper surface 24 of the base member 20 and/or the inner surface 52 of the front retaining wall 56; and the folded temples 311 being placed in communication with the upper surface 24 of the base member 20 and/or inner surface 52 of the back retaining wall 58, or with the outer surface 54 of the back retaining wall 58.

When eyewear 301 is in a folded or unfolded conformation, and placed on the eyewear holder 10, the different components of the device 10 can support the eyewear 301 at multiple sites.

The eyewear 301 can straddle the bridge supporting member 80, while engaging at least one additional location of the device 10. Portions of the bridge 307 of the eyewear 301 preferably engage with the top surface 82 and/or lateral surface 92 of the bridge supporting member 80.

The bottom surfaces of the lenses 305 preferably rest on an upper surface of the base member 20, where device 10 includes a base member 20.

A first, front retaining wall 56 preferably engages with an outer surface 317 of the lenses 305, the inner surface 52 of the front retaining wall 56 communicating with or touching outer surface 317 of the lenses 305.

Figure 4A:
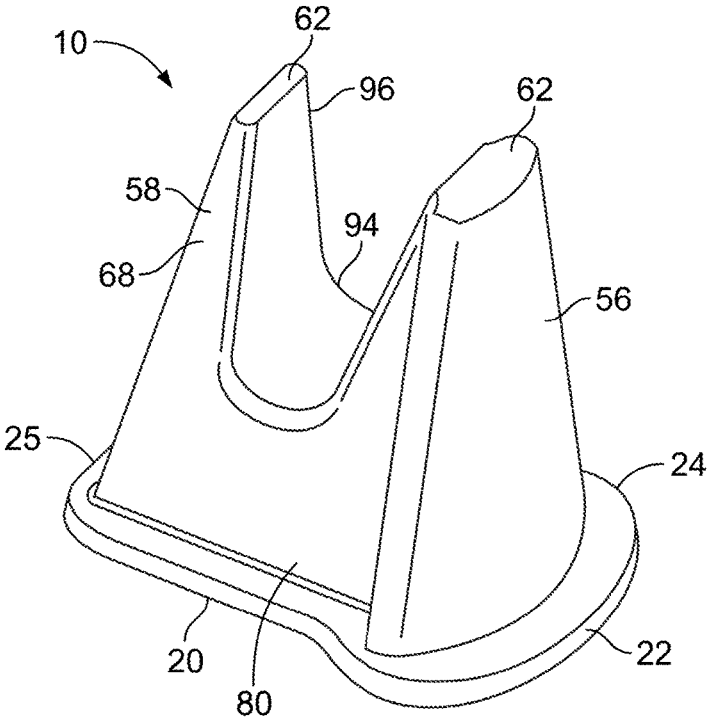
FIGS. 4A-4C show views of an embodiment of an eyewear holder, either alone (FIG. 4A) or holding eyeglasses (4B, 4C)
Figure 4B:
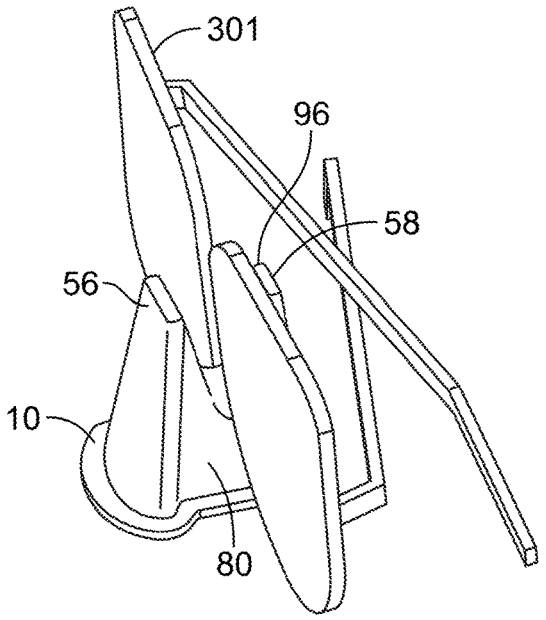
Figure 4C:
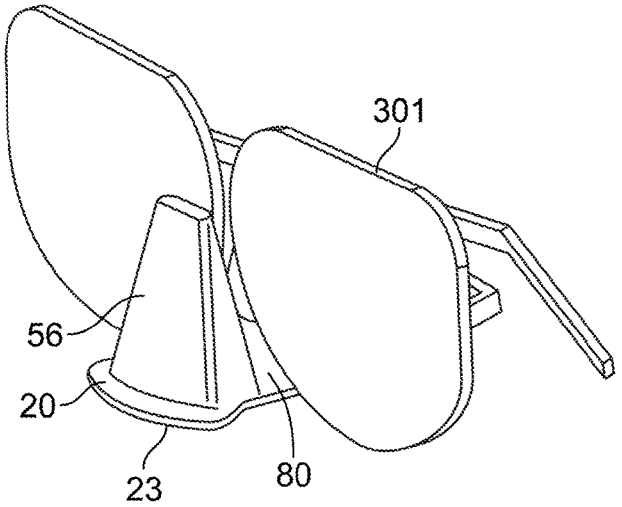

A second, back retaining wall 58 can engage with the folded temples 311 to aid, in conjunction with the bridge supporting member 80 and the base member 20, in retaining the eyewear 301 in a substantially vertical position with respect to the eyewear holder 10 and prevent the eyewear 301 from leaning or rotating. The temples 311 can communicate with the inner surface 52 of the back retaining wall 58, and thus be engaged between the retaining walls 56 and 58, with both retaining walls 56, 58 preventing or minimizing forward-and-backward or rotational movement by the eyewear 301, as shown in FIG. 3C. The temples 311 can communicate with the outer surface 54 of the back retaining wall 58, and thus be engaged outside of the area between the retaining walls 56 and 58, with the back retaining wall 58 preventing or minimizing forward-and-backward or rotational movement by the eyewear 301, as shown in FIG. 4B.

Where there is a front supplemental wall 161, the outer edges 71 can engage a front portion of the eyewear 301.

Where there is a back supplemental wall 163, the outer edges 71 can engage a back portion of the eyewear 301.

A retaining wall 56 and 58 can include a depression 66 for communicating with a portion of the eyewear 301, as shown in FIGS. 3A-3B, such as with the bridge 307 while the folded temples 311 communicate with the inner or outer surfaces 52, 54 of one or more retaining walls 56 and 58, or while the lenses 305 communicate with lateral surfaces 92 of the bridge supporting member 80.

In some preferred embodiments, the outer surfaces 317 of the lenses 305 communicate with the inner surface 52 of the front retaining wall 56, as shown in FIG. 4B. The outer surfaces 317 of the lenses 305 can communicate with internal projections extending from the inner surface 52 of the front retaining wall 56, the internal projections preventing or minimizing forward-and-backward or rotational movement by the eyewear 301.

Figure 7A:
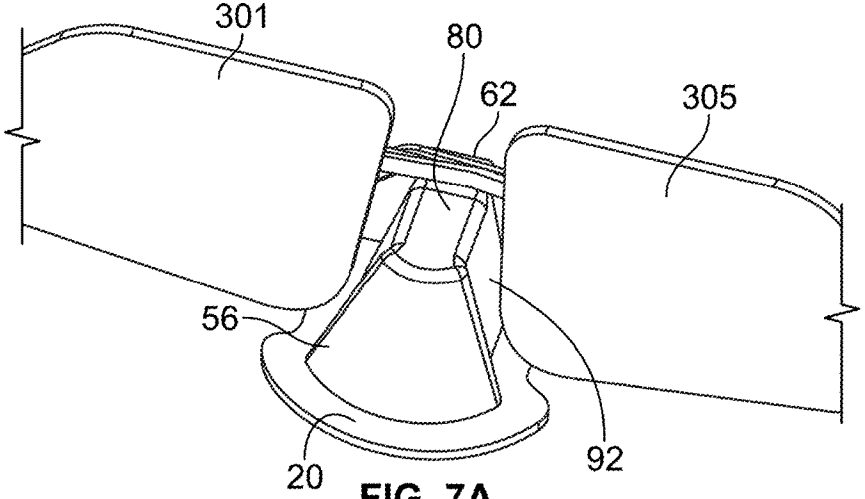
FIGS. 7A-7D show perspective views of an embodiment of an eyewear holder holding a pair of eyeglasses.
Figure 7B:
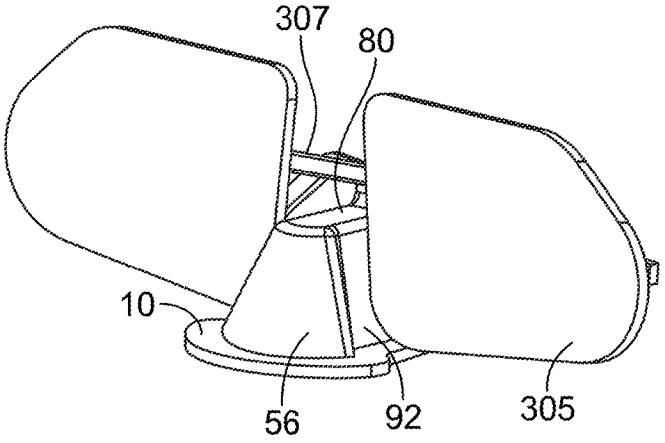
Figure 7C:
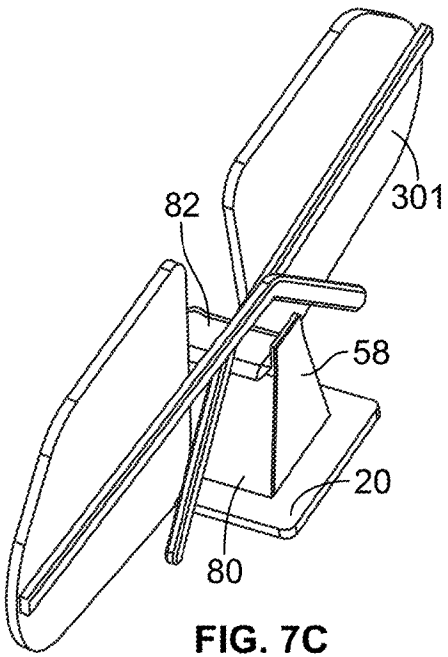
Figure 7D:
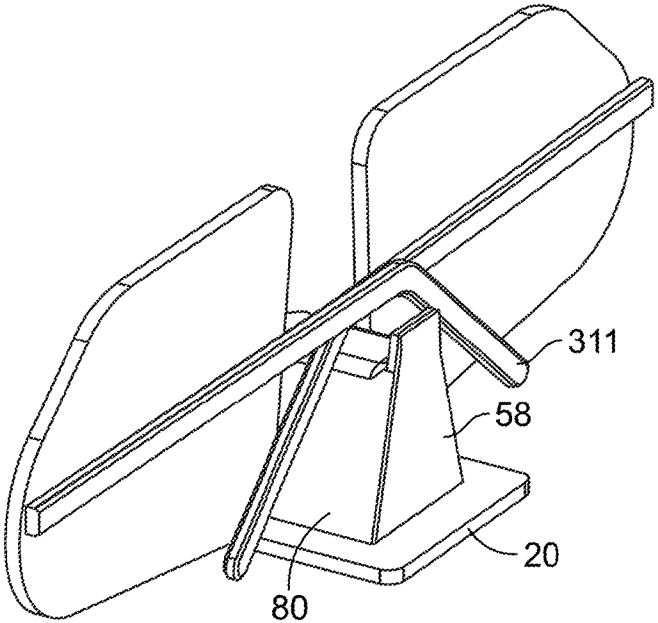

In some preferred embodiments, the folded temples 311 communicate with the inner surface 52 of the back retaining wall 58, though in other embodiments, the folded temples 311 can communicate with the rear or outer surface 54 of the back retaining wall 58, as shown in FIG. 7A. The folded temples 311 can communicate with projections extending from the inner or outer surface 52, 54 of the back retaining wall 58, the projections preventing or minimizing forward-and-backward or rotational movement by the eyewear 301.

Figure 5A:
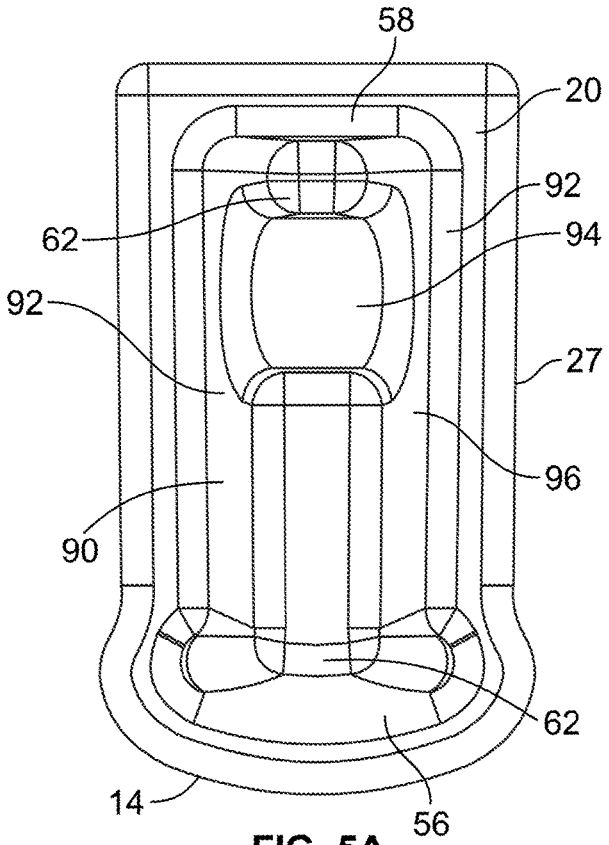
FIGS. 5A-5E show views of an embodiment of an eyewear holder; a top view (FIG. 5A), a perspective view (FIG. 5B), a front view (FIG. 5C), a side view (FIG. 5D), and a perspective view of the eyewear holder holding eyewear (FIG. 5E)
Figure 5B:
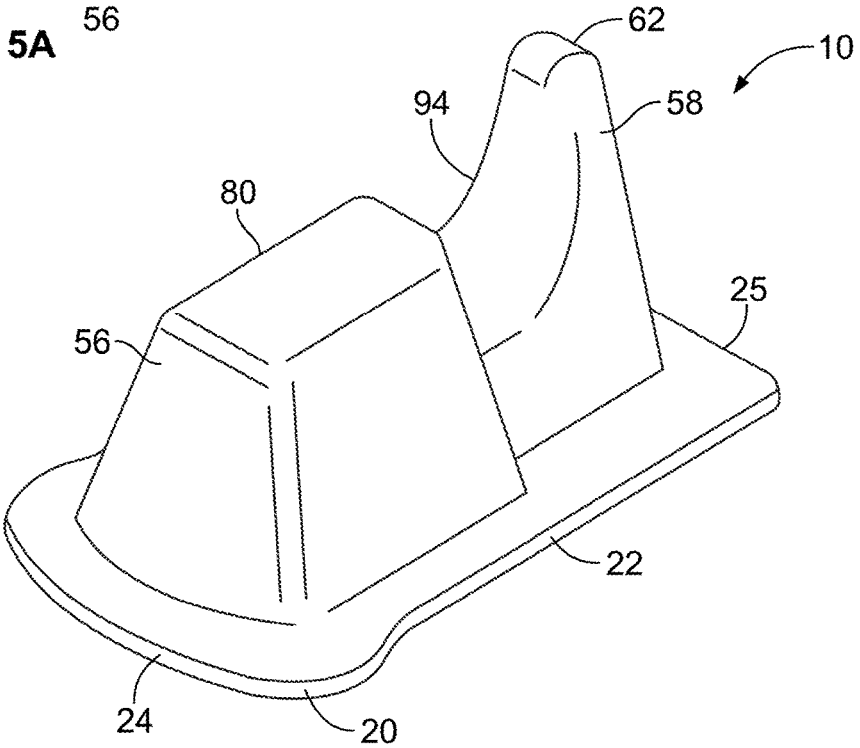
Figure 5C:
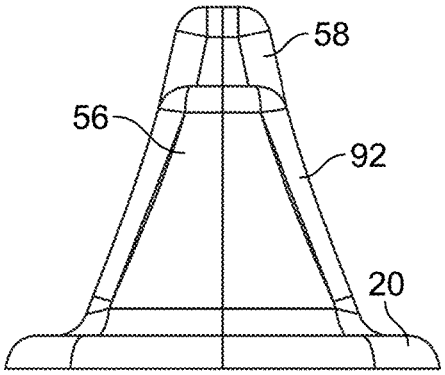
Figure 5D:
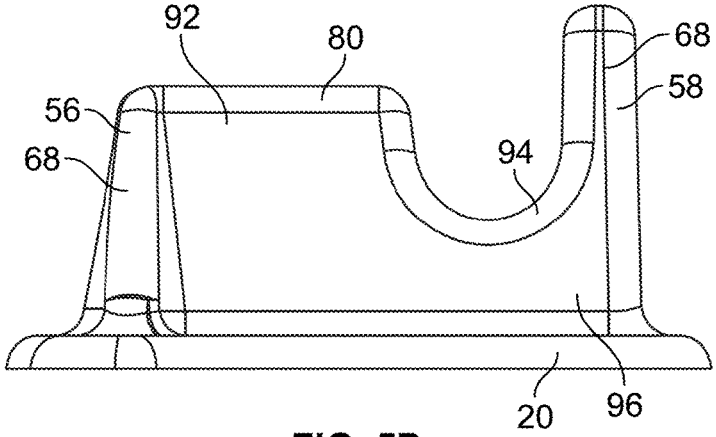
Figure 5E:
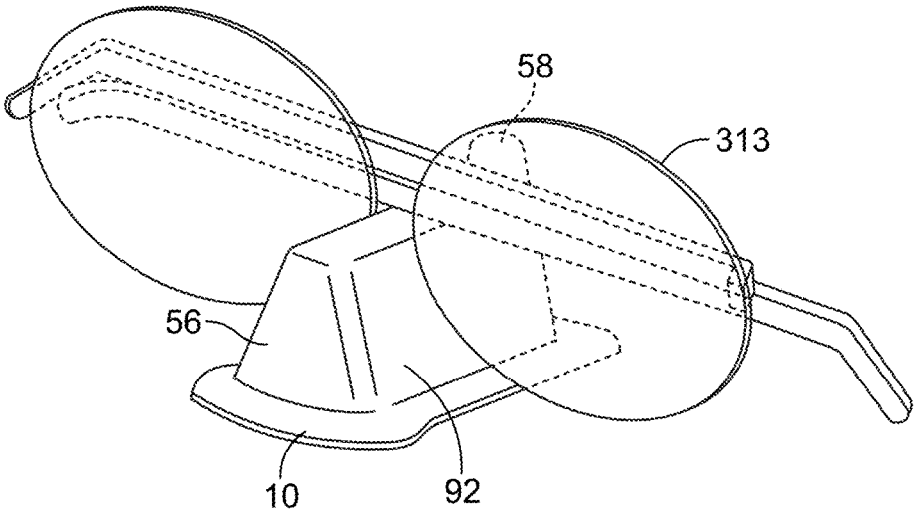
Figure 8C:
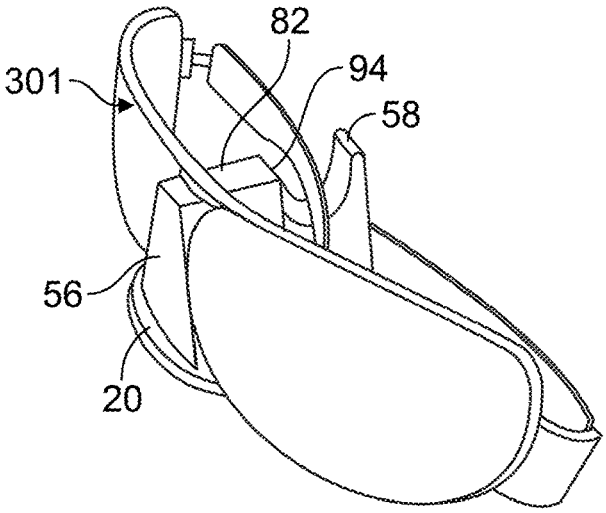

The bridge supporting member 80 can communicate with the bridge 307 and/or inner peripheral edges 313 of the lenses 305, as shown in FIGS. 5E and 7A. For example, the bridge 307 can rest atop the upper surface 82 of the bridge supporting member 80, as shown in FIG. 3B. The lateral sides 92 of the bridge supporting member 80 can communicate with the bridge 307 as shown in FIG. 6D or with the inner peripheral edges 313 of the lenses 305, as shown in FIG. 8C.

Where the bridge supporting member 80 has a depressed segment 94, that depressed segment 94 can support or communicate with the folded temples 311 of an eyeglass 301, as shown in FIGS. 8A-8B. The eyewear 301 can contact either a planar segment 98 or a depressed segment 94 of the upper surface 82 of the bridge supporting member 80, as shown in FIGS. 8A and 4B, respectively.

Where the device 10 is mounted onto another surface, the bottom surfaces of the lenses 305 can rest on or communicate with the base member 20, the surface on which the device 10 is mounted, or both surfaces. If the eyewear 301 contacts the surface on which the device 10 is mounted, then the eyewear 301 can adopt a position that is slightly angled, but still orients the eyewear 301 in a near vertical position. Similarly, if the device 10 is mounted onto another surface, the eyewear 301 can adopt or maintain a position that is slightly angled, but still orients the eyewear 301 in a near vertical position.

As described above, the lateral edges of the folded or unfolded eyewear 301 can be placed between a pair of supplemental walls 70, to minimize lateral movement of the eyewear 301 while engaged in the device 10.

Thus, the device 10 can firmly or loosely hold the eyeglass 301 in a stable, upright, near vertical orientation so that the lenses 305 of the eyeglass 301 are not scratched yet allow the eyeglass 301 to be easily removed when they are to be worn. Depending on the relative size and dimensions of the eyewear holder 10, when compared to the sizes and dimensions of a variety of different eyeglasses 301, an individual eyeglass 301 can fit snugly in the device 10, communicating with one or more of: the front and back retaining walls 56, 58, the upper and lateral surfaces 82, 92 of the bridge supporting member 80, the edge 71 of supplemental wall 70, and the upper surface 24 of the base member 20. Where the eyeglass 301 can move within the device 10 (when engaged or seated within the device 10), the eyeglass 301 can move to some degree, but is held close enough to ensure that the eyeglass 301 is unable to rotate out of its substantially upright position within the device 10.

The overall shape of the device 10 can be streamlined and designed to guide a user into conveniently and easily inserting the eyewear 301 into the device 10. The same shape can also guide the user to conveniently and easily grasp the eyewear 301 contained with the eyewear holder 10. The shape provide for was of insertion into and removal from the device 10.

The eyewear holder 10 can be used without a cover or encasement to further secure the eyewear 301 that it holds. The eyeglass holder 10 can secure the eyeglass 301 in a substantially upright position without requiring an additional piece of equipment to keep the eyeglass 301 in device and in a substantially upright alignment within the device 10. This feature makes the eyewear 301 held in the eyewear holder 10 easily accessible and readily removed from the eyewear holder 10 by a user of the product.

Mounted Embodiments

Embodiments of the eyewear holder 10 can be mounted to other surfaces or devices. As those skilled in the art will readily recognize, the substantially vertical support of eyewear 301 can allow for any combination of mounting techniques to be used in conjunction with the embodiments of the present invention. Some embodiments can comprise one or more members for mounting the device 10 to another surface. Such mounting members can include but are not limited to adhesives, magnets, rubber or plastic components, blocks, attachment feet, and the like.

The bottom surface 26 of the base member 20 can include protrusions extending outward and downward, the protrusions defining members for mounting the device 10 to another surface. Where the base member 20 is a regular polygon, such as a rectangle, a mounting member can be located at each corner of the regular polygon. Mounting members can be located on any surface of the device 10. A mounting member be made in any shape or height to accommodate different mounting surfaces.

The device 10 can include a mounting flange 22 extending outward and downward from the bottom surface of the base. Such mounting flange 22 can enable a user to mount the device 10 to a horizontal surface. Such mounting can be done with or without the assistance of tape, glue, or other adhesive or fixative compound. The amount of adhesive fixative component (e.g., single- or double-sided tape) needed to secure the mounted device can be varied by increasing or decreasing the surface area of the surface by which the device 10 is mounted. That is, a weaker adhesive (e.g., single-sided tape) can be used in embodiments of the device that have mounting surfaces with larger surface areas, compared to using a stronger adhesive (e.g., double-sided tape) in embodiments of the device that have mounting surfaces with comparatively smaller surface areas.

No mounting flange or mounting system is needed if the device 10 is positioned into a close-fitting location, such an recess shaped to receive the device 10, or if the device 10 can be affixed or packed into a projection, slot, or other structure. The device 10 can be mounted on a flat surface or on an angled surface to accommodate the eyewear 301 to be held within the device 10. Such angled surface can be between 0 degrees and 90 degrees, or between 10 and 80 degrees, or between 20 and 70 degrees, or between 30 and 60 degrees, or between 40 and 50 degrees, or even more preferably about 45 degrees.

The device 10 can include a mounting flange 22 extending outward and backward from the rear surface of the back retaining wall. Such mounting flange 22 can enable a user to mount the device 10 to a vertical surface.

The invention can be mounted on any flat surface, such as a table, desk, counter, or shelf. The eyewear holder 10 can be advantageously installed in kitchens, bathrooms, lockers, offices, automotive vehicles, boats, airplanes, and the like. It can be attached to computers or wherever there is a need for readily available eyeglasses 301.

While a variety of mounting systems are contemplated, the eyewear holder 10 can also secure eyewear 301 independent of any other support structure. That is, some embodiments of the eyewear holder 10 can merely be placed on a surface, free of fixatives or fasteners, to be used. Such embodiments can be highly portable, easily transported from one location to another location by a user, while the device 10 holds eyewear 301 or is empty. For example, a driver could place a pair of eyeglasses 301 in the eyewear holder 10 and place the eyewear holder 10 on a car seat or dashboard while driving, and then, when later exiting the vehicle, carry the engaged device 10 out of the car, place the engaged device 10 on a tabletop, and later retrieve the eyeglasses 301 from the device 10.

Additional Embodiments

The present invention is designed to adapt to a plurality of various sizes and styles of eyeglass 301, and can hold most sizes of standard eyeglasses or sunglasses. The invention can be adapted, however, to accommodate eyewear of non-standard size or shape (e.g., industrial safety visors, welding headgear with facial shields, chemical splash goggles, and the like).

The eyewear holder 10 can be light weight, aesthetically pleasing, and can be easily and conveniently oriented to secure a pair of eyeglasses 301, for easy retrieval as required or desired by the user of the product.

One of the advantages of the eyewear holder 10 is that its individual components can be made in various shapes and sizes to support eyeglasses 301 of different sizes and styles.

The outer surfaces of the device 10 can have a texture that is smooth, rough, or textured. The shape or contour of the outer surfaces can be flat, angled, or curved, and can be concave or convex. Any of the edges of the device rounded, chamfered, angled, or square; the edges can be smooth, rough, or textured.

The device 10 can be made of a rigid material such as wood or metal, a flexible, resilient polymeric material such as a nylon resin, or other thermoplastic material, molded to provide a support structure which is adapted to hold folded or unfolded eyeglasses or spectacles 301 in an upright and substantially vertical position when the device 10 rests or is mounted on a flat, horizontal surface or the device 10 is mounted on a flat, vertical surface. In some embodiments, the base member 20, retaining walls 56 and 58, and bridge supporting member 80 can be manufactured separately and assembled together.

The eyewear holder 10 is preferably made from a rigid material including but not limited to a rigid plastic material and can be opaque, semi-transparent, transparent, clear or colored as will be appreciated by those skilled in the art. The eyewear holder 10 can be made of a less rigid or a flexible material, such as certain plastics, gels, and The device 10 can be made of a single unitary item, for example, it can be molded as a single piece. That is, the base member 20, retaining walls 56 and 58, and bridge supporting member 80 can be fixed into place with respect to each other.

The foregoing description conveys the best understanding of the objectives and advantages of the present invention. Different embodiments may be made of the inventive concept of this invention. Different features can be incorporated or excluded from different embodiments. It is to be understood that all matter disclosed herein is to be interpreted merely as illustrative, and not in a limiting sense.

What is claimed is:

1. A device for holding an eyeglass, having:

a base member;

a bridge supporting member atop the base member, the bridge supporting member including:

first and second lateral walls, each lateral wall joining a central portion of the base member, and each lateral wall facing a lateral side of the base member; and a front end extending in a planar manner from the second lateral wall to the first lateral wall and terminating at the first lateral wall a top surface comprising first, second, and third segments, respectively, the first segment joining the second segment at a first transverse angle, and the second segment joining the third segment at a second transverse angle; and a front retaining wall atop the base member, the front retaining wall between the bridge supporting member and the front side of the base member;

wherein when the eyeglass is seated in the eyeglass holder, each of the base member, front retaining wall, the second segment, third segment, the first lateral wall, and the second lateral wall are configured for communicating with a different location of the eyeglass; and wherein when the eyeglass straddles the bridge supporting member, the front retaining wall is configured for restricting a forward movement of the eyeglass, the second segment is configured for restricting a backward movement of the eyeglass, and the bridge supporting member for restricting a sideward movement of the eyeglass, and the eyeglass is maintained in a substantially upright position.

2. The device of claim 1, wherein a central portion of the front retaining wall is located proximate to the front end of the bridge supporting member.

3. The device of claim 1, comprising a plurality of front retaining walls, each front retaining wall proximate to the front side of the base member, and each front retaining wall for restricting the forward movement of the eyeglass when the eyeglass straddles the bridge supporting member.

4. The device of claim 3, wherein the front retaining walls define a common plane.

5. The device of claim 1, comprising a back retaining wall proximate to the back side of the base member, the back retaining wall for communicating with a folded temple of the eyeglass;

wherein when the eyeglass straddles the eyeglass holder, the back retaining wall for restricting the backward movement of the eyeglass when the eyeglass straddles the eyeglass holder.

6. The device of claim 5, the back retaining wall including:

a central portion proximate to the back end of the bridge supporting member; and an end portion flanking each side of the central portion, each end portion proximate to a lateral side of the base member.

7. The device of claim 5, the front retaining wall and the back retaining wall defining a slot, the slot transverse to the bridge supporting member, and the slot for engaging the eyeglass.

8. The device of claim 5, wherein a height of the front retaining wall is less than a height of the back retaining wall, and the height of the back retaining wall is less than a height of the bridge supporting member.

9. The device of claim 1, each lateral wall joining the bridge supporting at a transverse angle, and each lateral wall extending toward each other.

10. The device of claim 1, wherein the bridge supporting member comprises a fourth segment, the fourth segment extending between the third segment and the back end of the bridge supporting member at a third transverse angle.

11. A device for holding an eyeglass, the eyeglass in a folded or unfolded configuration, consisting of:

a base member;

first and second retaining walls extending upward from the base member; and an elongated bridge supporting member extending between the retaining walls in a planar manner, the elongated bridge supporting member having first and second ends joining the first and second retaining walls, respectively; and an upper surface, the elongated bridge supporting member adapted for receiving a bridge of the eyeglass;

the upper surface comprising:

a first segment having a first height, the first segment joining the first retaining wall;

a second segment joining the first segment to a third segment, the second segment positioned at a transverse angle between the first and second segments;

the third segment having a second height, the third segment joining the second retaining wall; and first and second lateral walls opposite each other, each lateral wall extending between the top surface and the base member;

wherein when the eyeglass is held in the device, a first portion of the eyeglass is positioned between the retaining walls, the elongated bridge supporting member for communicating with a second portion of the eyeglass, and the eyeglass adopts a substantially upright position.

12. The device of claim 11, wherein when the eyeglass is held in the device, the retaining walls are spaced close enough to prevent the eyeglass from adopting a horizontal position.

13. The device of claim 11, wherein when the eyeglass is held in the device, the base member communicates with a third portion of the eyeglass.

14. The device of claim 11, the elongated bridge supporting member comprising first and second lateral walls, each lateral wall extending between the base member and the upper surface of the elongated bridge supporting member;

wherein, when the eyeglass is held in the device, each lateral wall communicates with a fourth portion of the eyeglass.

15. The device of claim 11, wherein the elongated bridge supporting member has a width greater than or equal to 0.050 inches and less than or equal to 1.25 inches.

16. The device of claim 11, wherein the device has a height of greater than or equal to 0.250 inches and less than or equal to 3.000 inches.

17. A device for holding an eyeglass, the eyeglass in a folded or unfolded configuration, comprising:

a base member;

first and second retaining walls extending upward from the base member; and an elongated bridge supporting member between the retaining walls, the elongated bridge supporting member having first and second ends joining the first and second retaining walls, respectively; and an upper surface, the elongated bridge supporting member adapted for receiving a bridge of the eyeglass;

wherein when the eyeglass is held in the device, a first portion of the eyeglass is positioned between the retaining walls, the elongated bridge supporting member for communicating with a second portion of the eyeglass, and the eyeglass adopts a substantially upright position, and further including at least one supplemental wall, the at least one supplemental wall connecting to a lateral side of one retaining wall, and extending toward another retaining wall;

wherein when the eyeglass is held in the device, the at least one supplemental wall supports the first portion of the eyeglass.

* * * * *